US010941993B2

(12) United States Patent
Overstreet et al.

(10) Patent No.: US 10,941,993 B2
(45) **Date of Patent: *Mar. 9, 2021**

(54) RADIAL DELAYED BLOWBACK OPERATING SYSTEM FOR A FIREARM INCORPORATING A ROTATIONAL INDUCING PROFILE ESTABLISHED BETWEEN BOLT LUGS AND A MATING RECEIVING PATTERN WITHIN THE UPPER RECEIVER OR A TRUNNION INSTALLED WITHIN THE RECEIVER

(71) Applicant: 22 Evolution LLC, Boonville, MO (US)

(72) Inventors: John L. Overstreet, Fayette, MO (US); Tyson Bradshaw, Boonville, MO (US); Jordan Wilson, Blue Springs, MO (US)

(73) Assignee: 22 Evolution LLC, Boonville, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/784,765

(22) Filed: Feb. 7, 2020

(65) Prior Publication Data

US 2020/0333094 A1 Oct. 22, 2020

Related U.S. Application Data

(60) Continuation-in-part of application No. 16/233,586, filed on Dec. 27, 2018, now Pat. No. 10,557,673,
(Continued)

(51) Int. Cl.
*F41A 3/26* (2006.01)
*F41A 3/30* (2006.01)
(Continued)

(52) U.S. Cl.
CPC *F41A 3/26* (2013.01); *F41A 3/30* (2013.01); *F41A 3/82* (2013.01); *F41A 19/30* (2013.01)

(58) Field of Classification Search
CPC ..... F41A 3/26; F41A 3/30; F41A 3/82; F41A 3/54; F41A 19/30
(Continued)

(56) References Cited

U.S. PATENT DOCUMENTS 1,159,059 A 11/1915 Mauser
3,507,187 A 4/1970 Maillard
(Continued)

FOREIGN PATENT DOCUMENTS

GB 873475 A 7/1961

*Primary Examiner* — Jonathan C Weber
(74) *Attorney, Agent, or Firm* — Dinsmore & Shohl LLP

(57) ABSTRACT

A delayed rotary blowback mechanism integrated into a firearm bolt and carrier subassembly. A plurality of radial locking lugs are configured at a rear end of the bolt and seat within a mating profile of an upper receiver interior or integrated trunnion in a fully chambered position. A plurality of chamfered locations are configured between the lugs and a receiving profile in the barrel or trunnion for influencing linear to rotational motion of the bolt. A cam pin extends upwardly from the bolt and seats through a circumferentially directed slot configured within the bolt carrier. Upon initiating of the discharge cycle, signaled by the round traveling through and out the end of the barrel, the chamfered configuration results in the bolt and cam pin rotating within the carrier and the lugs subsequently separating from the receiver or trunnion, with the bolt and associated carrier retaining sufficient inertia to cycle through the discharge cycle to the set position concurrent with reloading a subsequent cartridge.

20 Claims, 31 Drawing Sheets

Related U.S. Application Data which is a division of application No. 15/791,595, filed on Oct. 24, 2017, now Pat. No. 10,436,530.

(60) Provisional application No. 62/412,537, filed on Oct. 25, 2016.

(51) Int. Cl.
*F41A 19/30* (2006.01)
*F41A 3/82* (2006.01)

(58) Field of Classification Search
USPC ..... 89/180, 182, 183, 188, 191.01, 191.02, 89/192
See application file for complete search history.

(56) References Cited

U.S. PATENT DOCUMENTS

| | | | |
|---|---|---|---|
| 3,554,077 | A | 1/1971 | Schlapia, Jr. |
| 3,710,492 | A | 1/1973 | Tirrell |
| 3,893,369 | A | 7/1975 | Benelli |
| 4,028,993 | A | 6/1977 | Reynolds |
| 4,272,902 | A | 6/1981 | Waters |
| 4,604,942 | A | 8/1986 | Benelli |
| 5,770,814 | A | 6/1998 | Ealovega |
| 5,911,173 | A | 6/1999 | Westrom |
| 6,044,748 | A | 4/2000 | Westrom |
| 6,484,430 | B1 | 11/2002 | Robinson et al. |
| 6,530,306 | B1 | 3/2003 | LaFleur |
| 6,609,319 | B1 | 8/2003 | Olson |
| 6,829,974 | B1 | 12/2004 | Gwinn, Jr. |
| 6,848,351 | B1 | 2/2005 | Davies |
| 6,910,404 | B2 | 6/2005 | Wolff et al. |
| 6,971,202 | B2 | 12/2005 | Bender |
| 7,627,974 | B2 | 12/2009 | Olson |
| 8,087,194 | B1 | 1/2012 | Vuksanovich |
| 8,161,864 | B1 | 4/2012 | Vuksanovich |
| 8,356,543 | B2 | 1/2013 | Rosol et al. |
| 8,459,164 | B2 | 6/2013 | Lilburn et al. |
| 8,459,165 | B2 * | 6/2013 | Doll ..... F41A 9/32 89/17 |
| 8,677,883 | B2 | 3/2014 | Wossner et al. |
| 8,783,158 | B2 | 7/2014 | Kerbrat et al. |
| 8,899,141 | B2 | 12/2014 | Reynolds et al. |
| 9,057,572 | B2 | 6/2015 | Matteson |
| 9,080,823 | B1 | 7/2015 | Mantas |
| 9,103,611 | B2 | 8/2015 | Neitzling |
| 9,234,713 | B1 | 1/2016 | Olson |
| 9,347,719 | B1 | 5/2016 | Stone |
| 9,448,020 | B1 | 9/2016 | Olson |
| 9,513,076 | B2 | 12/2016 | Kolev et al. |
| 9,863,729 | B2 | 1/2018 | Blank |
| 9,885,529 | B2 | 2/2018 | Lewis |
| 9,970,721 | B1 | 5/2018 | Oglesby |
| 2003/0183068 | A1 | 10/2003 | LaFleur |
| 2005/0011346 | A1 | 1/2005 | Wolff et al. |
| 2008/0276797 | A1 | 11/2008 | Leitner-Wise |
| 2011/0094373 | A1 | 4/2011 | Cassels |
| 2012/0013787 | A1 | 1/2012 | Chiang |
| 2012/0131834 | A1 | 5/2012 | Barrett et al. |
| 2012/0131835 | A1 | 5/2012 | Barrett et al. |
| 2012/0240760 | A1 | 9/2012 | Pizano |
| 2013/0074390 | A1 | 3/2013 | Wossner et al. |
| 2013/0219763 | A1 | 8/2013 | Nunes |
| 2014/0075807 | A1 | 3/2014 | Lewis |
| 2014/0076144 | A1 | 3/2014 | Gomez |
| 2014/0224114 | A1 | 8/2014 | Faxon |
| 2014/0230642 | A1 | 8/2014 | Reynolds et al. |
| 2014/0259843 | A1 | 9/2014 | Matteson |
| 2015/0007478 | A1 | 1/2015 | Barrett et al. |
| 2015/0135942 | A1 | 5/2015 | Gomez |
| 2015/0260467 | A1 | 9/2015 | Blank |
| 2015/0330727 | A1 | 11/2015 | Kolev et al. |
| 2016/0187082 | A1 | 6/2016 | Pizano |
| 2016/0370135 | A1 | 12/2016 | Plumb et al. |
| 2017/0074607 | A1 | 3/2017 | Lewis |

* cited by examiner

FIG. 33
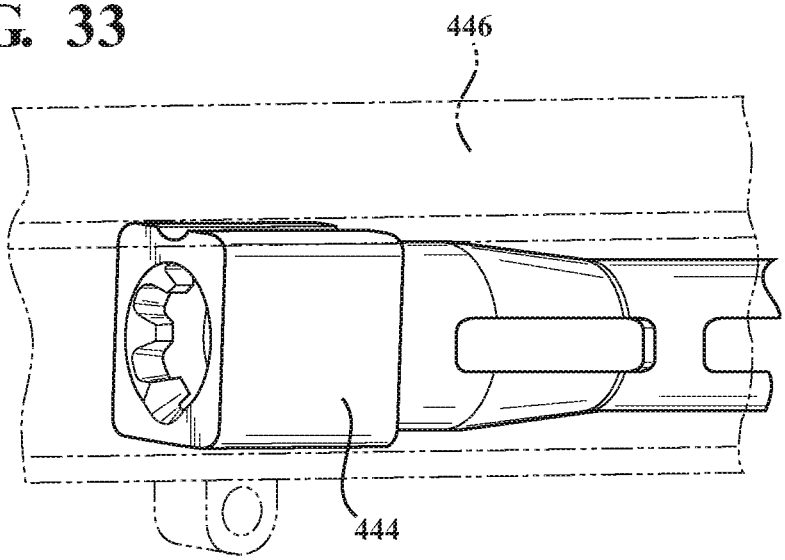
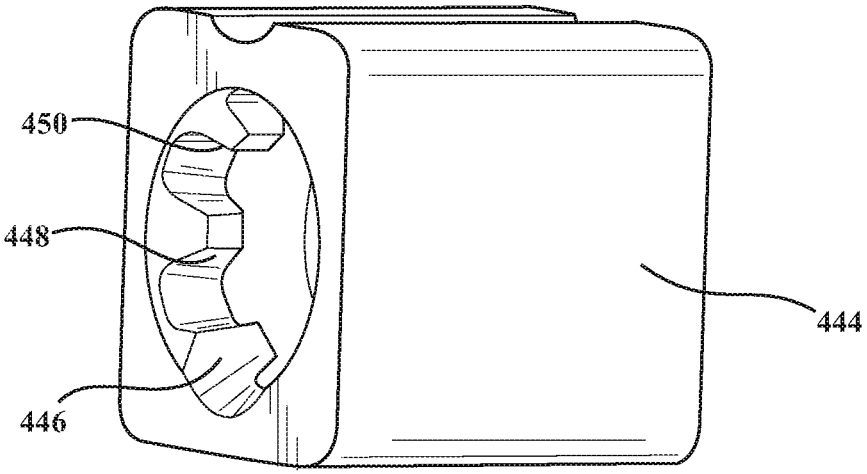
FIG. 34

RADIAL DELAYED BLOWBACK OPERATING SYSTEM FOR A FIREARM INCORPORATING A ROTATIONAL INDUCING PROFILE ESTABLISHED BETWEEN BOLT LUGS AND A MATING RECEIVING PATTERN WITHIN THE UPPER RECEIVER OR A TRUNNION INSTALLED WITHIN THE RECEIVER

CROSS REFERENCE TO RELATED APPLICATIONS

The present application is a continuation in part of U.S. Ser. No. 16/233,586 filed Dec. 27, 2018. The '586 application is a divisional of U.S. Ser. No. 15/791,595 filed Oct. 24, 2017. The '595 application claims the priority of U.S. Ser. No. 62/412,537 filed Oct. 25, 2016.

FIELD OF THE INVENTION

The present invention relates generally to delayed blowback assemblies. More specifically, the present invention teaches improvements in a radial attenuation of recoil forces associated with a cycling bolt within an upper receiver action assembly, such utilizing chamfering of the mating profile established between the bolt lugs and an opposing pattern of receiving lugs integrated into either of the upper receiver or a trunnion component integrated into the upper receiver and to which is engaged a barrel of the firearm.

BACKGROUND OF THE RELEVANT ART

The prior art discloses various types of firearm action assemblies for attenuating, or reducing the recoil associated with a firearm cartridge discharge. A first example of these is depicted in Benelli U.S. Pat. No. 3,893,369 which teaches a pistol having a bolt provided with ribs extending transversely to the bolt axis and adapted to engage in and disengage from corresponding mating grooves provided in the receiver breech upon a slight rotation of said bolt with respect to said receiver breech. A locking link provided between the bolt and the bolt carrier is caused, upon firing, to rotate in such a direction that said link holds said bolt urged against the receiver breech, with said ribs engaged in the mating grooves. Once the inertial force of said bolt carrier has failed, the residual pressure of exhaust gases applies a force to said bolt which causes the bolt to rotate with respect to said receiver breech so as to disengage said ribs from the associated grooves in said receiver breech.

A further example is depicted in Plumb, US 2016/0370135 which teaches a recoil impulse reducing bolt carrier group including a main bolt carrier group body for the intended weapon system and a recoil impulse reducing assembly. The recoil impulse reducing assembly fits inside the main bolt carrier group body. The recoil impulse reducing assembly includes an interchangeable weight and a dampener, such as springs or fluid. The weight moves within the main bolt carrier group body under hydraulic and/or spring tension. The recoil impulse reducing bolt carrier group manipulates weight distribution during the operation of the firearm to prevent and reduce front and rear recoil forces from affecting the firearm.

Another example is shown in Kerbrat U.S. Pat. No. 8,783,158 for a delayed blowback mechanism including a main frame (1) and its extension (1'), which accommodate a barrel (21) with fixed mounting, a mobile bolt (22) and its guiding pin ensemble (66) and main spring (67) moving in the main frame (1), a mobile mass (34) and its assembly of guiding pin (60), push plate (61) and return spring (62), and a mobile mass catch sear (42) and its spring (7). The mobile mass pivots from a first position under the barrel to a downward position in reaction to the backward movement of the mobile bolt. The placement of the mobile mass in front of the chamber directs counteracting forces down on the barrel to prevent muzzle climb during operation.

Finally, another example of a recoil absorption device, such as for use within the family of semi-automatic or automatic AR-15/M-16 and M4 carbines, is depicted in U.S. Pat. No. 9,103,611 to Neitzling which teaches a barrel attached to an upper receiver and including a compressible bolt carrier extension system. The compressible bolt carrier extension system includes a bolt carrier, an extension spring, two pins, and a reciprocation bolt carrier extension piece. As a whole, the compressible bolt carrier extension system makes possible the use of elongated upper and lower receivers to be used for chambering long-action or other center fire cartridges for use with AR rifles such as the M-16, and M4 etc., eliminating the need for any buffer or buffer tubes other than those commercially available. A further advantage of the compressible bolt carrier extension system is the reduction of felt recoil as the system fully loads during the recoil stroke as it pushes against the buffer absorbing additional recoil energy. The system can be incorporated into firearms using a variety of cartridges.

SUMMARY OF THE PRESENT INVENTION

The present invention discloses a rotary delayed blowback assembly for any type of firearm not limited to an AR-15/M4 type carbine having a gas impingement driven action assembly. The assembly includes the addition of any type of angled, chamfered or rounded contour or profile applied to either or both of the radially projecting and rear contact surfaces of the bolt locking lugs and the separating inward projections defining the extension grooves configured within an upper receiver or a separate trunnion integrated into the receiver. In either variant, the trunnion grooves seat the bolt lugs in the forward most displaced position of the bolt carrier group within the upper receiver or receiver integrated trunnion during the chambering of cartridge and prior to a trigger pull and cartridge discharge event occurring.

Typical chambering motion of the bolt carrier group involves the cam pin projecting from the bolt seated within the bolt carrier, the cam pin displacing within a cam slot configured within the bolt carrier during seating/unseating of the bolt within the barrel receiver. Known configurations of the bolt lugs and receiver or incorporated trunnion groove patterns provide for rotating of the lugs following them being fully seated rearward of the receiver or trunnion configured grooves, this in order to engage or disengage opposing rear inner abutment surfaces of the extension projections defining the grooves of the upper receiver or incorporated trunnion component.

The chamfering aspect of the present invention occurs at a contact interface established between the bolt lugs and receiver/trunnion grooves during initial cartridge discharge, this combined with any suitable reconfiguration of the cam pin and slot architecture so as to utilize this interface in order to provide radial delay and attenuation of the forces exerted upon the bolt during radially induced cartridge discharge (such resulting from a portion of these forces being absorbed by the shouldering interface between the lugs and grooves) combined with reduction in weight and felt recoil of the firearm. In contrast, and as again taught in the existing art, the cam pin and slot architecture requires all rotational action to occur after the lugs are seated rearwardly of the receiver (and inward projection) defined grooves.

In this fashion, the bolt initially rotates into the battery in a first cartridge chambering motion, with the subsequent force associated with discharge of the round (such redirected to the bolt) causing the bolt to counter-rotate in an unlocking direction and along a rotary travel profile established between the chamfer profile on the locking lugs and the mating receiving pattern configured within the barrel extension, such occurring throughout the linear displacing unseating of the lugs from the receiver (or incorporated trunnion) grooves (and again not prior to unseating). Upon completion of the rotary counter-motion, the bolt unlocks (i.e. separates from the upper receiver or associated trunnion component) and it, along with the carrier, completes the translating and reciprocating cycle associated with the assembly action.

A further embodiment incorporates a bolt alignment spring which biases the carrier supported bolt and firing pin in opposite directions, with the bolt being biased forwardly (in the direction of the receiver nut) and the firing pin biased rearwardly in its natural state. The biasing force of the spring is rated sufficiently light so as not to affect the normal action or firing sequence of the bolt assembly during cycling while being sufficiently stiff in order to maintain the bolt in proper alignment upon extraction and feeding of the cartridges in succession from the magazine.

BRIEF DESCRIPTION OF THE DRAWINGS

Reference will now be made to the attached drawings, when read in combination with the following detailed description, wherein like reference numerals refer to like parts throughout the several views, and in which:

FIG. 33 is a partial perspective illustration of a further variant of a trunnion component incorporated into an upper receiver, further depicted in phantom; and FIG. 34 is an illustration of the trunnion component of FIG. 33.

DETAILED DESCRIPTION OF THE PREFERRED EMBODIMENTS

With reference to the attached illustrations, the present invention discloses a rotary delayed blowback for use with a firearm. As will be further described, the present design is applicable, in one non-limiting variant, for use with a standard AR15 platform and which in application can be utilized with other caliber designs which have historically been too powerful for use with straight blowback assemblies, as well as to weak or complicated for use with other gas operated systems.

Figure 4:
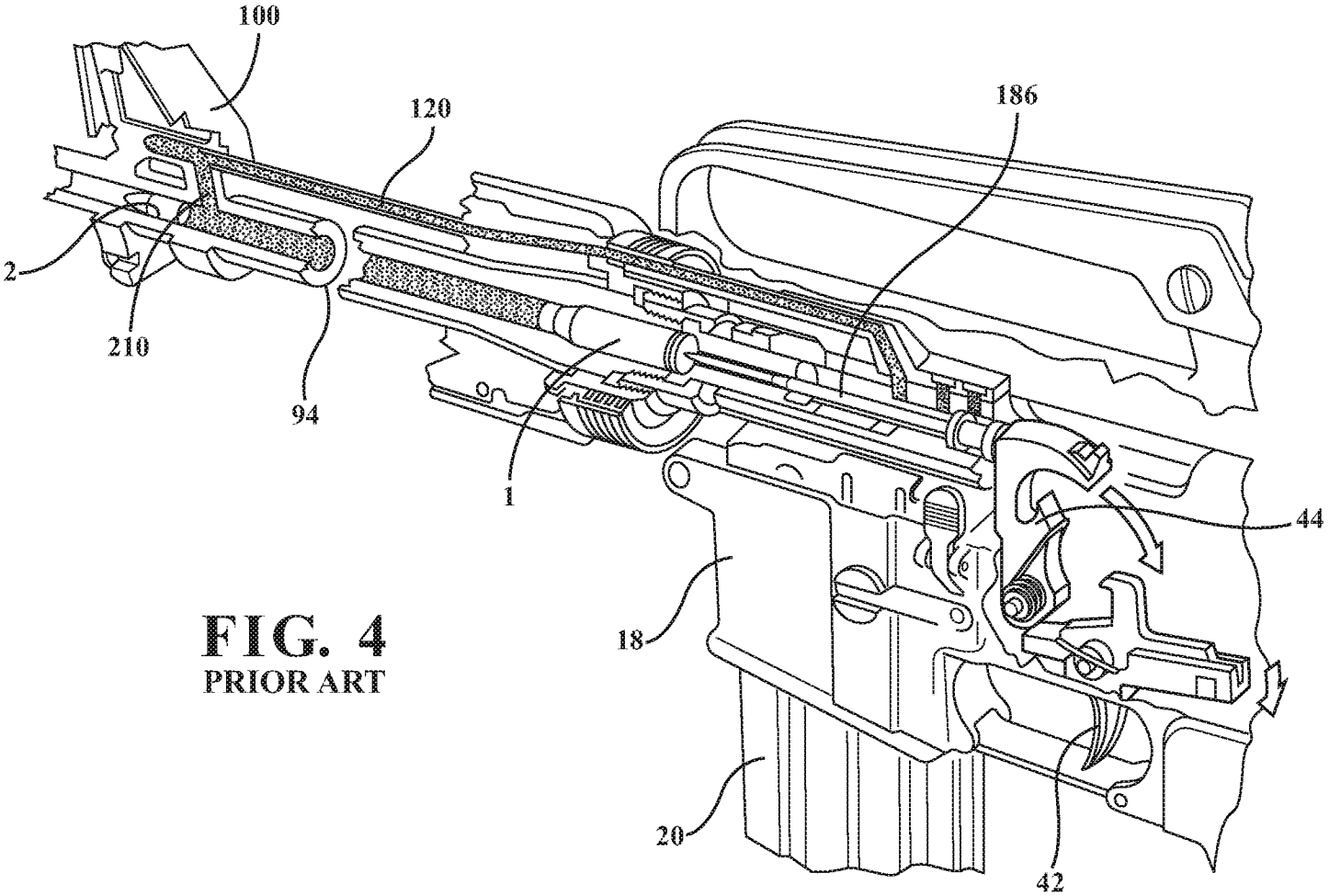
FIG. 4 PRIOR ART
FIG. 4 is a Prior Art illustration of a direct gas impingement system associated with cartridge discharge for providing reciprocating motion of the bolt assembly.
Figure 5:
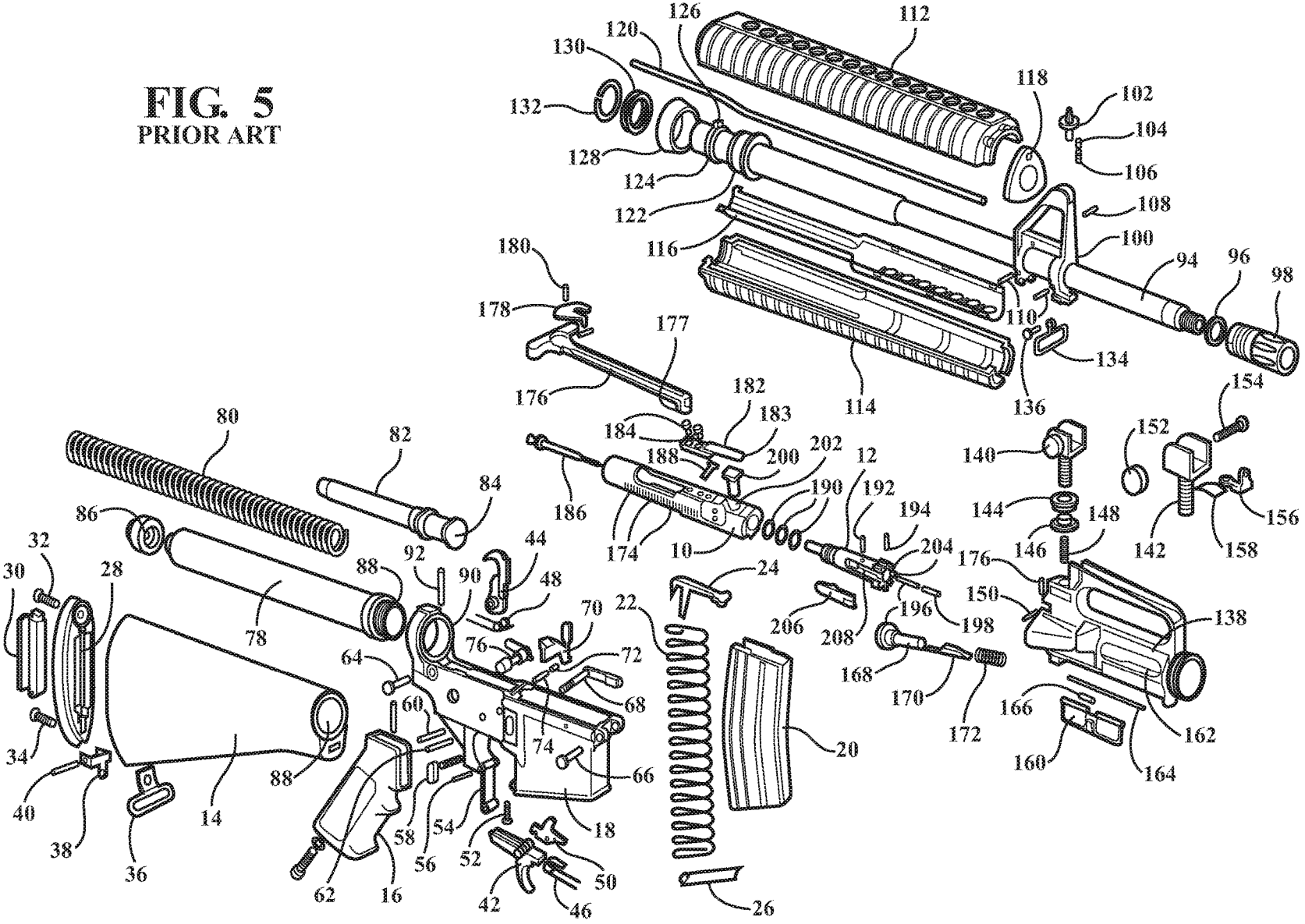
FIG. 5 PRIOR ART
FIG. 5 is an additional exploded Prior Art view of upper and lower receiver assemblies associated with an AR-15 type firearm.

Prior to a detailed description of the bolt rotating/blowback cycle depicted in the several variants, the present invention is understood to be applicable to any suitable type of firearm platform not limited to an AR-15 type semiautomatic rifle, such being generally represented in additional detail in the Prior Art depictions of FIG. 4-5. As an initial note, the cycling mechanism used in the original AR-15 is known as a direct gas impingement system (see FIG. 4), and in which a bolt carrier (referenced at 10 in FIG. 5) acts as a movable cylinder with an internally supported bolt 12 itself acting as a stationary piston.

The prior art exploded view of FIG. 5 provides an illustration of the components associated with a standard AR-15, including those integrated into each of upper and lower receivers. While it is understood that, without limitation, the radial delayed blowback assembly is capable of being integrated into any suitable firearm, a brief overview of the known components of the firearm according to the illustrated variant is useful in providing a better understanding of the interplay of the bolt carrier group and associate components.

The lower receiver subassembly includes each of a buttstock 14, pistol style hand grip 16 and a main lower receiver frame 16 including underside accessible magazine receiving cavity. A cartridge supporting magazine 22 is provided for retaining a plurality of interiorly inserted cartridges (not shown), these being upwardly biased by a magazine spring 22 located between an upper follower 24 and a bottom engaging floor plate 26.

Additional buttstock components include a rear engaging buttplate 28 within which is configured an access door 30. A pair of screws 32/34 secure the buttplate 28 to the open cavity defining rear of the buttstock 14. Other features include a rear sling loop 36, access door hinge 38 and access door hinge pin 40.

A trigger 42 and hammer 44 are provided within the lower receiver body and which are biased via respective springs 46 and 48. A disconnector 50 is integrated into the trigger 42 via spring 52. A trigger guard 54 is integrated into the trigger housing and pivotal about pin 56. A magazine release button 58 and associated catch spring is provided for releasing the magazine 20 from within the bottom receiver frame well. Additional hammer 60 and trigger 62 pins are provided for supporting the hammer, trigger and associated pins in the receiver lower frame in order to establish the desired cock, release and reset positions attendant with the discharge and reload steps associated with operation of the AR-15 type firearm.

Each of rear takedown pin 64 and forward pivot pin 66 are provided for assembling the upper and lower receivers together. A magazine catch 68 and (last shot hold open) bolt catch 70 (with plunger 72 and spring 74) are provided. A safety select lever is shown at 76.

Finally, the recoil absorbing and reverse reloading aspect of the lower assembly (relative to the bolt carrier group) is provided by a lower receiver rear extension tube 78 within which is supported an action spring 80 and a forward seating buffer assembly 82, the latter having a flat end face 84 which is contacted by the recoil displaced bolt carrier 10. A buttcap spacer 86 extends from a rear of the receiver extension tube 78 for supporting the same within the buttstock interior and so that a forward annular threaded end 88 of the tube engages through a supporting and upwardly extending eyelet 90 of the lower receiver housing and is held in place a buffer retainer pin 92.

The upper subassembly includes a barrel 94 having, at its forward end, a peel/crush washer 96 and forward-most flash suppressor or compensator 98. A front sight 100 is secured to a forward proximate end of the barrel 94 with each of a front sight post 102, front sight detent 104, front sight detent ring 106, gas tube roll pin 108 and lower front sight taper pins 110 completing the sight subassembly.

A pair of upper 112 and lower 114 split (typically thermoset) handguards are provided for assembly about the barrel 94, with a heatshield hand guard liner further depicted at 116 and sandwiched between the handguards. A handguard cap 118 is provided at a sandwiched forward end of the handguards about the barrel and a gas tube 120 (further reference to which will be made in reference to FIG. 4) is provided between the upper handguard and the barrel.

Integrated into the rear of the barrel 98 is a bolt lug receiving nut 122 (the configurations of which along with those of the bolt lugs forming portions of the present invention), along with a barrel extension 124 (including barrel indexing pin 126). Also disclosed is a delta ring 128, weld spring 130 and barrel retaining ring (or hand guard snap ring) 132. A front sling swivel 134 and associated rivet 136 secure to the barrel underside and, in combination with the rear swivel 36 associated with the lower receiver, allow a sling (not shown) to extend therebetween.

An upper receiver housing 138 is provided (typically a forged aluminum) an which supports the bolt carrier group and associated components, the operation of which in a recoil attenuating and radial delayed manner being an objective of the present invention. A rear sight assembly 140 and rear sight base 142 are provided secured atop the upper housing 138. A rear sight elevation index 144 and elevation knob 146 are depicted, along with a rear sight elevation spring 148 and associated pin 150 for supporting the rear sight. A windage knob 152 and screw 154 secure to opposite sights of the rear sight base 142, along with a rear sight aperture 156 and flat spring 158.

A dust cover/ejection port 150 is depicted and which is hingedly secured over an ejection port window (see perimeter 162) configured into the upper housing 138. An ejection port cover pin 164 and associated ejection port spring 166 are provided for hingedly securing an upper edge of the pivotal ejection port 150.

A forward assist plunger 168 (for assisting in manually reseating an incompletely forward displaced bolt into the receiver nut) is provided and which includes a forward assist pawl 170 and spring 172 for securing to the housing 138 for iteratively contacting serrated side locations (see at 174) associated with the bolt carrier 10. A forward assist spring pin 176 completes the installation of the forward assist into the upper housing.

Finally, a description of a standardized bolt carrier group, the modification of which being among the objectives of the present invention, includes a charging handle 176 with front underside engagement shoulder 177, latch 178 and roll pin 180 which assembles along with the carrier 10 into a rear of the upper housing 138. A bolt carrier key 182 is assembled, by key screws 184, to a top of the bolt carrier 10. A forward edge 183 of the key is engaged by the underside shoulder 177 of the charging handle 176 in the installed position.

A firing pin 186 is secured, via a side installing retaining pin 188, within a rear of the bolt carrier 10. The bolt 12 installs, via a plurality (such as three) of gas rings 190 into a front of the bolt carrier 10. Each of an extractor pin 192 and extractor roll pin 194 secure to a top of the bolt 12, with an extractor spring 196 and ejector 198 securing to a forward end of the bolt.

A cam pin 200 secures to a top of the bolt 12 and projects upwardly through an arcuate slot 202 configured into the top of the bolt carrier. As previously described, the cam pin contacts an interior guiding location within the upper receiver housing in order to rotate the bolt 12 (in the existing art following linear displacement of forward most located and radially projecting bolt lugs 204 associated with the bolt 12) in fully seating fashion beyond the associated inward projections of the barrel receiver or nut (again 122). Finally, an extractor 206 (with associated spring and pin) is installed into a side location 208 of the bolt 12 for engaging and chambering each of a succession of cartridges from the receiver during return forward motion of the bolt 12 (as influenced by the forward return biasing motion of the action spring 80 and buffer assembly 82).

Having provided an exemplary description of the components of a typical AR-15 type firearm, FIG. 4 further illustrates a standard direct gas impingement discharge protocol for providing the necessary recoil forces exerted upon the bolt carrier group and in order to rearward displace the bolt into a sufficient return biasing contact with the action spring and buffer assembly for completing the return forward cycling and chambering of a subsequent magazine fed cartridge. This includes a forward proximate gas port 210 located in communication between the barrel 94 and the return gas tube 120.

Accordingly, and in operation once the trigger 42 is pulled with the bolt 12 fully forwardly seated within the barrel receiver 122 and a cartridge 1 chambered forward of the bolt within the barrel, the trigger 42 released the hammer 44 which in turn strikes the firing pin 186 in order to create a small explosion to ignite volume of gunpowder contained with the cartridge (such as along with an igniting cap). Rapidly burning powder creates pressurization which discharges a forward most projectile 2 for travel through and out the forward end of the barrel 94 past the muzzle suppressor 98.

The generated gas is tapped from the barrel as the bullet moves past a gas port located above the rifle's front sight base (see again FIG. 4). The gas expands into the port and down a gas tube, located above the barrel that runs from the front sight base into the AR-15's upper receiver. Here, the gas tube protrudes into a "gas key" (bolt carrier key), which accepts the gas and funnels it into the bolt carrier.

At this point, the bolt is locked into the barrel extension by the locking lugs, so the expanding gas forces the bolt carrier backward a short distance (prior to actuation of the bolt). As the bolt carrier moves toward the butt of the gun, the bolt cam pin, riding in a slot on the bolt carrier, forces the forwardly disposed bolt to rotate and thus unlocks it from the barrel extension. Once the bolt is fully unlocked it begins its rearward movement along with the bolt carrier. At this point, the bolt's rearward motion extracts the empty cartridge case from the chamber and, as soon as the neck of the case clears the barrel extension, the bolt's spring-loaded ejector forces it out the ejection port in the side of the upper receiver.

Behind the bolt carrier is the plastic or metal buffer 82 with forward face 84, which rests in line with the heavy duty action/return spring 80, which begins to push the bolt carrier and bolt back toward the chamber once it is compressed sufficiently. A groove (not shown) machined into the upper receiver housing 138 guides the bolt cam pin 200 and prevents it and the bolt from rotating (via the receiving slot 202 configured into the carrier) into a closed position. The bolt's locking lugs 204 push a fresh round from the magazine 20 as the bolt 12 moves forward. The round is guided by feed ramps into the chamber. As the bolt's locking lugs move past the inward groove defined projections within the barrel extension 122, the cam pin 200 (at this point) twists into a pocket milled into the upper receiver. This twisting action follows the groove cut into the carrier and forces the bolt to twist and "lock" into the barrel extension and in order for the discharge and reload cycle to repeat as described.

Given the above explanation of the conventional discharge/reload operation of an AR-15 type firearm, the present invention seeks to improve upon this standardized operation by introducing an additional radial delayed blowback of the bolt carrier group during the unlatching motion from the barrel receiver, this so that the interface between the bolt lugs and the barrel receiver nut grooves can cause the bolt to initiate a recoil force attenuating rotation during the unseating interface motion and not, as in the Prior Art, only rotating the bolt when bolt lugs are most forwardly displaced in a fully chambered position with the lugs projecting forwardly beyond the opposing inner rear edges of the barrel nut receiving (and inward projection defining) grooves. It is concurrently an objective of the invention to maintain sufficient recoil generating force of the bolt carrier group, following radially delayed and unseating disengagement of the bolt lugs from the barrel receiver grooves, so as to generate sufficient return displacing force by the action spring and forward contacting buffer assembly, for return displacing the bolt carrier group into a fully seated re-engagement within the barrel and receiver nut.

Figure 1:
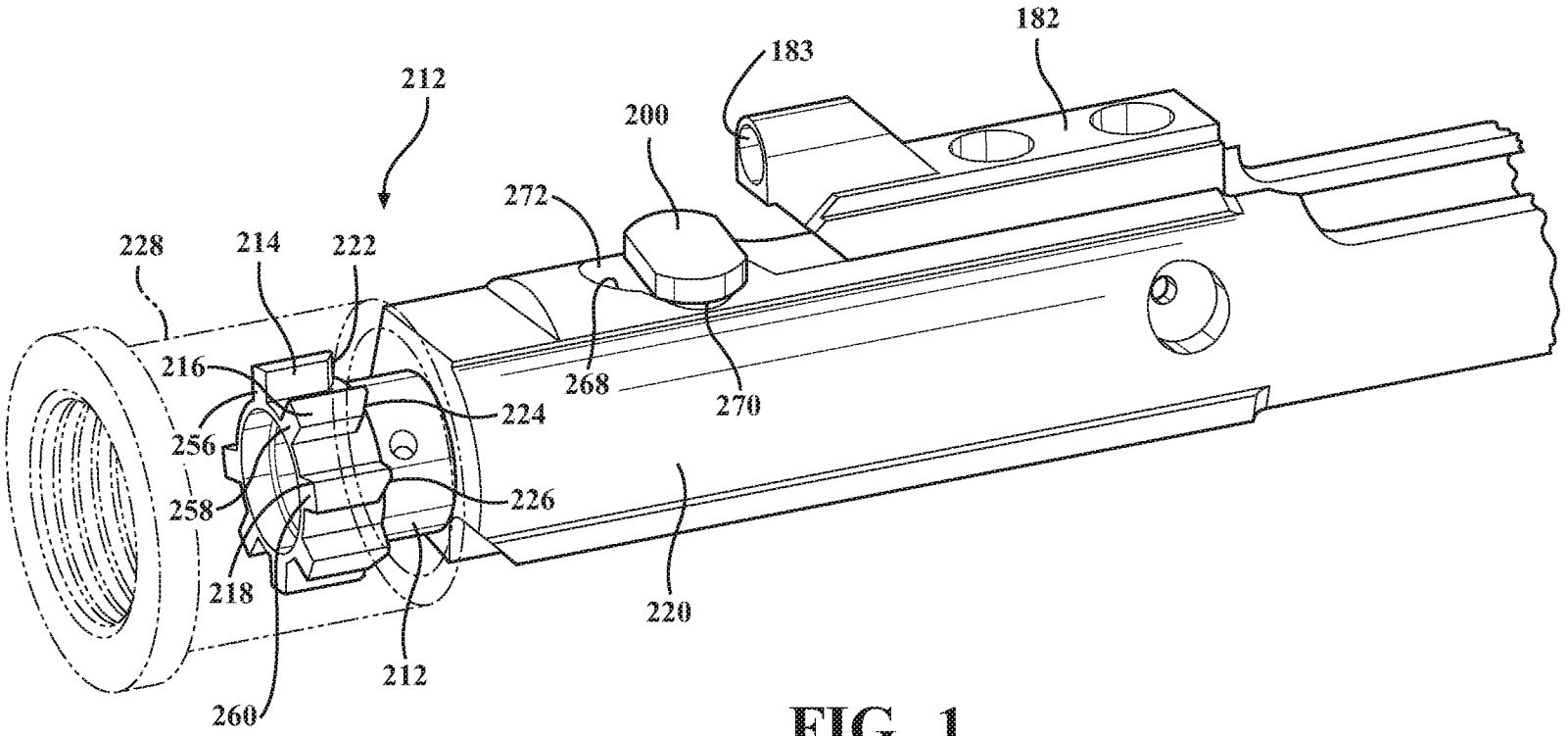
FIG. 1 is an illustration in partial cutaway of a bolt in a fully rotated engagement position when supported within an upper receiver battery of an AR15 style firearm, a barrel receiver being illustrated in phantom within which the forward disposed lugs of the bolt are seated.
Figure 2:
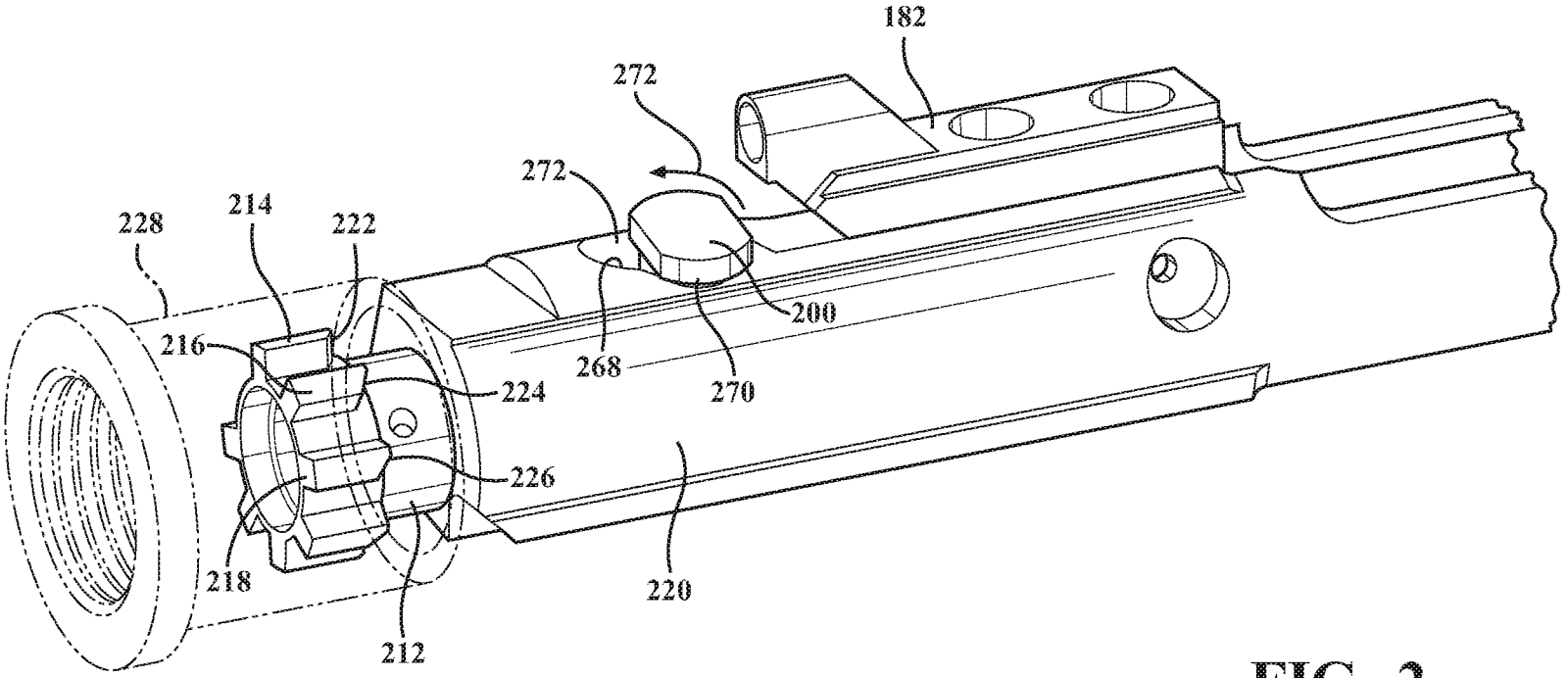
FIG. 2 is a succeeding illustration initiating a start of a delayed sequence for accomplishing a rotary blowback of the bolt and corresponding with the chamfer configured on the back edges of the circumferentially spaced locking lugs being caused to rotate upon contact with the barrel extension in response to axial forces exerted from the discharged cartridge.
Figure 3:
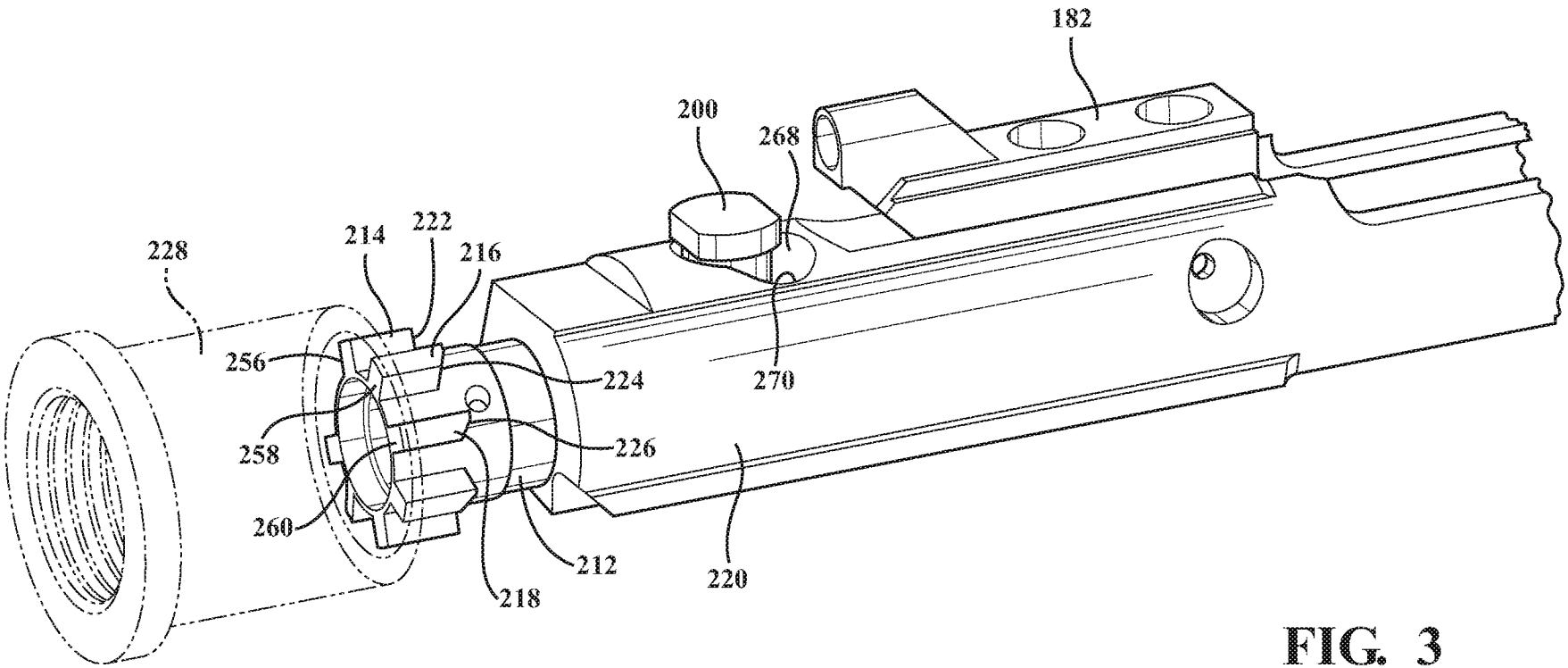
FIG. 3 is a further illustration of the bolt fully rotated to the unlocked and rearwardly displaced position, this occurring upon the locking lugs unseating from the mating receiving profile of the barrel extension as dictated by the range of bolt rotation permitted by the cam pin and receiving slot.

With reference initially to FIGS. 1-3, an explanation will now be provided as to the rotary delayed blowback assembly according to the present invention (FIGS. 1-3), such as which integrates reconfigurations to specified components of the standard AR-15 firearm as described above. As will be further described, this reconfiguration includes modifications to each of the bolt (12), the bolt carrier (10), as well as reconfiguration of the slot 202 in the carrier, through which extends a reconfigured and circumferentially displaceable cam pin 200.

As further depicted in each of FIGS. 1-3 in succession, a general illustration is shown at 212 (FIG. 1) in partial cutaway of a bolt in a fully rotated engagement position when supported within an upper receiver battery of an AR15 style firearm, and which a barrel receiver being illustrated in phantom within which the forward disposed lugs of the bolt are seated. As previously described, the carrier, bolt and receiver are all reconfigured from that depicted in the prior art illustrations to incorporate the redesigns described herein for providing the desired tuning of the bolt carrier group action in order to accomplish radial delayed blowback during the action cycle.

FIG. 2 is a succeeding illustration initiating a start of a delayed sequence for accomplishing a rotary blowback of the bolt and corresponding with the chamfer configured on the back edges of the circumferentially spaced locking lugs being caused to rotate upon contact with the barrel extension in response to axial forces exerted from the discharged cartridge. FIG. 3 is a further illustration of the bolt 212 fully rotated to the unlocked and rearwardly displaced position, this occurring upon the locking lugs unseating from the mating receiving profile of the barrel extension as dictated by the range of bolt rotation permitted by the cam pin and receiving slot.

As depicted a plurality of radially projecting locking lugs are shown at 214, 216, 218, et seq., and which are configured in a circumferentially extending pattern associated with a rear end of the bolt (hidden from view inside the interior of a modified bolt carrier 220). As further shown, the inner (back) end of the lugs each further depicts a chamfered or angled edge, these being specifically represented by chamfer edges 222, 224 and 226 for respective lugs 214, 216 and 218.

Further depicted in phantom is a barrel extension 228 (see as compared to at 122 in FIG. 5). The interior profile of the barrel extension includes a mating and receiving pattern of lug recesses for seating the radial locking lugs 102, 104, 106, et seq., this being shown with initial reference to the rotated sectional perspective of FIG. 8 of the barrel extension 228 which illustrates an interior of the barrel extension which can include a plurality of interior spiral receiving threads 230 (such as which can be engaged to the barrel 94 as shown in FIG. 5).

The barrel extension 228 further includes a reconfigured groove receiving pattern which is defined within and between a plurality of circumferentially spaced and inwardly radial projections 232, 234, 236 et seq., between which are defined the configured receiving grooves (see at 238, 240, 242 et seq.). As further shown in FIG. 8, the inward projections of the barrel nut interior include inside chamfer surfaces, at 244, 246, 248, et seq. for inward projections 232, 234, 236.

As explained previously, the present invention provides for rotational inter-displacement between the bolt lug patterns and barrel extension interior groove patterns during rotational to linear displacement of the bolt in the cartridge discharging and rearwardly unseating motion of the bolt relative to the barrel extension as depicted in FIGS. 1-3. The barrel nut interior groove patterns are further depicted by radial narrowed leading contact edges 250, 252, 254, et seq. which transition to the chamfer surfaces 244, 246, 248, et seq., and provide the rotational to linear interface with the bolt lug patterns (again depicted by forward chamfer edges 222, 224, 226, et seq.) for causing bolt rotation (concurrent with guided cam pin in slot rotation) in order to seat the bolt in the fully forward positioned (cartridge ready discharge) position of FIG. 1 in which rear radial surfaces of the lugs (see further at 256, 258, 260, et. seq. as best shown in FIG. 3) pass the chamfer profiles of the interior grooves and abut against opposing inner seating end surfaces (at 262, 264, 266, et. seq. in FIG. 8) associated with each of the inward circumferential spaced radial projecting portions 232, 234, 236, et seq. In this fashion, and upon the bolt being fully seated as shown in FIG. 1, the radial locking lugs fully mesh within the receiving lug and groove defined recesses of the barrel extension.

Figure 6:
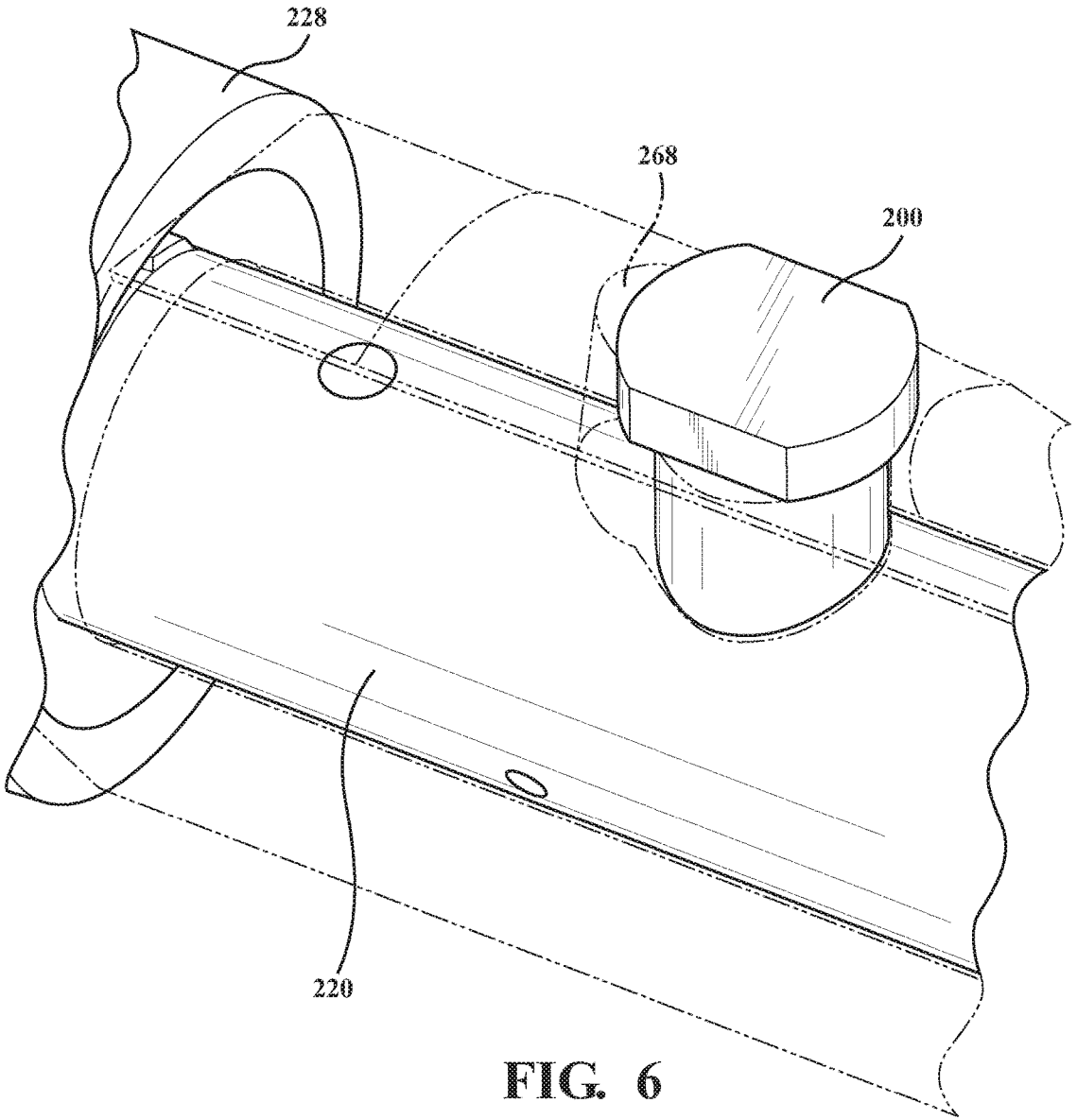
FIG. 6 is partially transparent phantom perspective of a modified cam and pin slot configuration for use with the radially delayed bolt assembly of the present invention.

As further shown in FIGS. 1-3, an offset slot (see inner perimeter edge profile 268 which can be reconfigured from that previously depicted at 202 in the Prior art view of FIG. 5) is configured in an upper surface of the bolt carrier 220, at a location between the rear end of the carrier and top mounted bolt key (again shown at 182 in FIG. 5). Bolt cam pin 200 (which can be the same or reconfiguration of that shown in FIG. 5) is provided and which seats through the slot defining offset interior perimeter 268 in a fashion which causes the bolt key 182 to abut an edge location 270 of the interior perimeter 268 defining the slot as shown in FIGS. 1-2. This is also referenced in FIG. 6 which additionally shows in phantom the arrangement of the bolt carrier 220 within the upper receiver (also in phantom) in communication with the barrel extension 228.

FIG. 2 is a succeeding illustration initiating a start of a delayed sequence for accomplishing a radial to axial tuned blowback of the bolt, this corresponding with the inter-engaging chamfer profiles as previously described and which are configured on the back edges of the circumferentially spaced locking lugs, causing them to rotate upon contact with the barrel extension recessed lug pattern in response to axial forces exerted from the discharged cartridge (and consistent with the prior art explanation of the gas impingement discharge cycle of FIG. 4). This is further reflected by directional arrow 272 in FIG. 2 which corresponds to the concurrent forward and circumferential directional forces exerted on the bolt.

FIG. 3 is a further illustration of the bolt fully rotated to the unlocked and rearwardly displaced position, this occurring upon the locking lugs 214, 216, 218, et seq., unseating from the mating receiving profile of the barrel extension grooves (see again FIG. 8) as dictated by the range of bolt rotation permitted by the cam pin 200 and bolt carrier defined receiving slot 268. At this position, the cam pin 200 abuts an opposite circumferential edge location 274 of the carrier slot 268 (see FIG. 3) this corresponding to unrestrained forward travel of the carrier consistent with the discharge/reload cycle previously described.

As further described, the rotary blowback assembly is designed so that an adequate degree of inertia exists to allow the bolt and carrier to cycle through the entire action. Beyond the variant illustrated herein, it is also again understood and envisioned that the rotary blowback assembly can be integrated into other action assembly configurations associated with additional firearm designs. It is also understood that the rotary blowback configuration, both as articulated in the present description and illustrations, can also be reconfigured for adaptation to other firearm designs. As further noted, the chamfer profiles can exist along either or both of the forward edges of the radial projecting bolt lugs and the opposing receiving surfaces of the circumferentially spaced and radial inward projecting grooves of barrel extension (e.g. again as initially depicted in FIG. 8).

The present invention contemplates a variety of variants in which rotation of the bolt (via lugs) occurs along the interface with the barrel extension grooves (and as opposed to the prior art in which the lug rotation occurs exclusively beyond the rear radial seating edges of the barrel groove portions (again at the fully forward chambered location of the bolt within the receiver extension). In this fashion, radial delayed and attenuating blowback of the bolt and carrier is possible as previously described.

Figure 7:
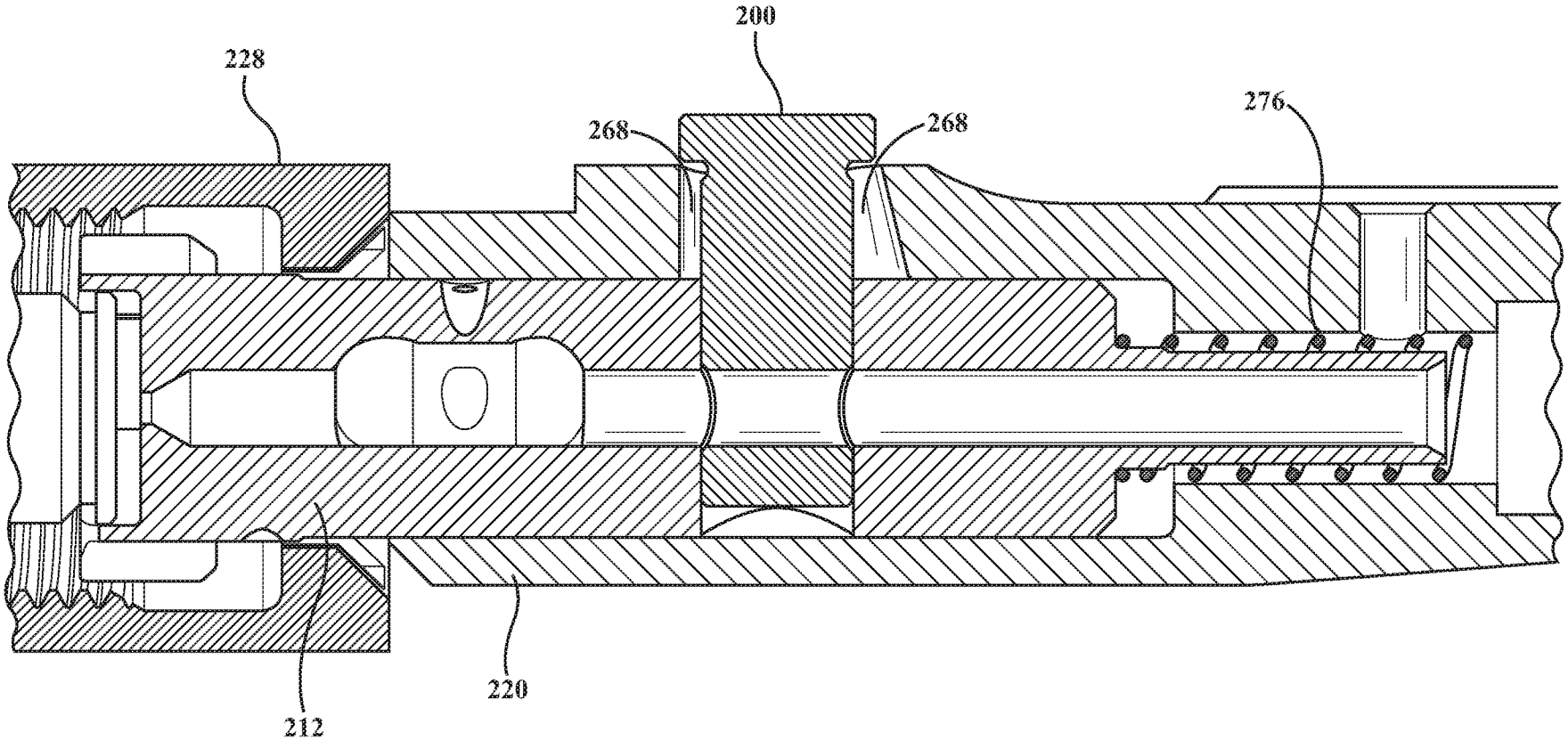
FIG. 7 is a plan cutaway of a modified bolt and carrier and which includes the provision of a bolt alignment spring which biases the carrier supported bolt and a firing pin in opposite directions, with the bolt being biased forwardly in the direction of the receiver nut and the firing pin biased rearwardly in its natural state.
Figure 12:
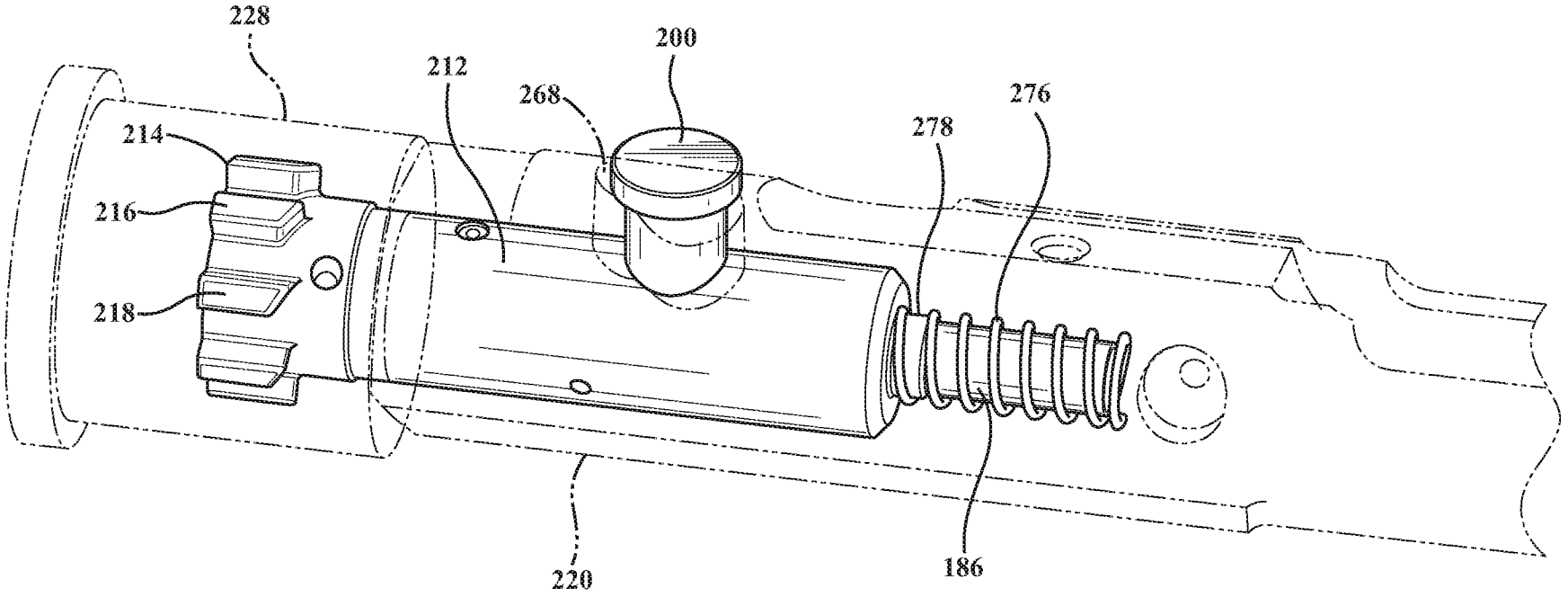
FIG. 12 is a partial perspective of the bolt supported within the bolt carrier (phantom) and depicting the rear end supporting bolt alignment spring of FIG. 7.
Figure 13:
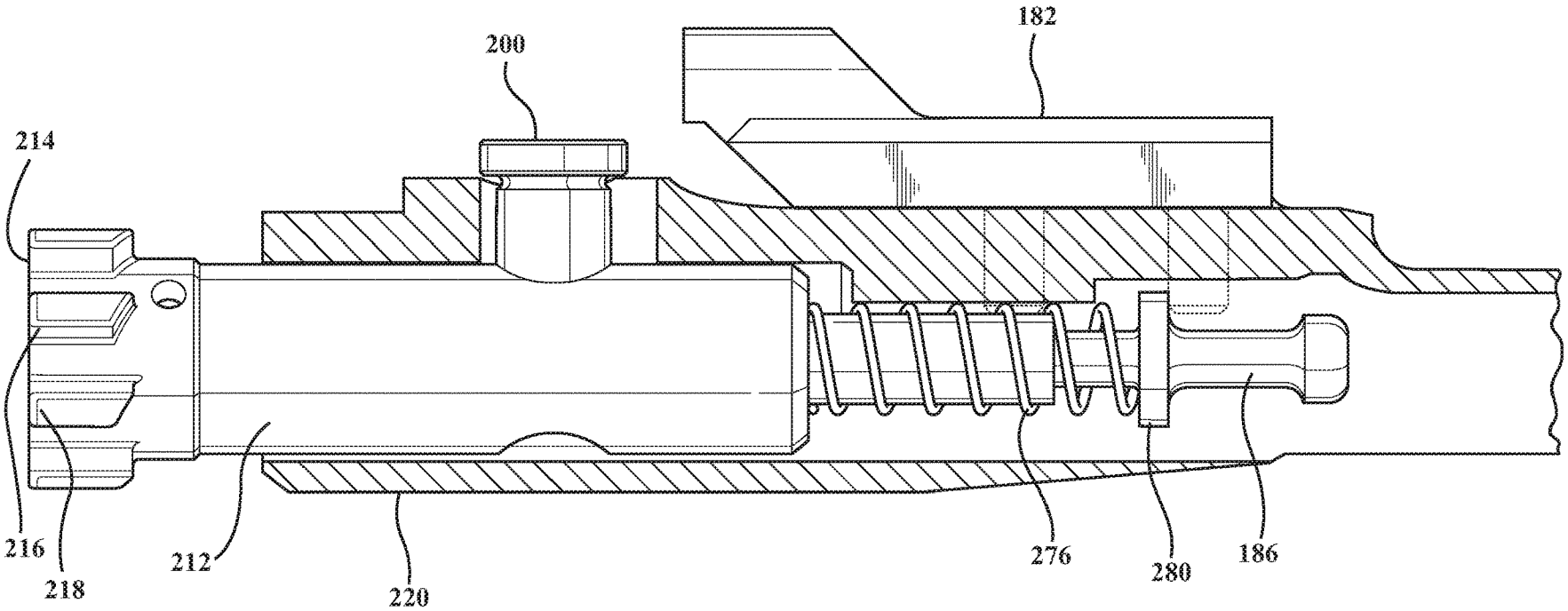
FIG. 13 is a linear cutaway of bolt carrier group as depicted in FIGS. 7 and 12 and illustrating the configuration of the bolt alignment spring biasing the carrier supported bolt and firing pin in opposite directions.

Proceeding to FIG. 7, a plan cutaway is presented of a modified bolt and carrier and which includes the provision of a bolt alignment spring, see at 276 and as is also depicted in each of FIGS. 12-13. FIG. 12 additionally provides a partial perspective of the bolt supported within the bolt carrier (phantom), and depicting the rear end supporting bolt alignment spring of FIG. 7, with FIG. 13 a linear cutaway of bolt carrier group as depicted in FIGS. 7 and 12, and illustrating the configuration of the bolt alignment spring biasing the carrier supported bolt and firing pin in opposite directions.

The bolt alignment spring 276 biases the carrier supported bolt and firing pin 186 (as best shown in FIGS. 12-13) in opposite directions, with the bolt being biased forwardly (in the direction of the receiver extension) and the firing pin biased rearwardly in its natural state. As best shown in FIG. 12, the bolt 212 can include a rear end projection 278 which provides a seat for biasing the forward end of the spring 276, with an opposite rearward end of the spring biasing against an annular projecting collar (at 280 in FIG. 13) associated with the firing pin 186. In this manner, the biasing force of the spring 276 is rated sufficiently light so as not to affect the normal action or firing sequence of the bolt assembly during direct impingement cycling, while being sufficiently stiff in order to maintain the bolt in proper alignment upon extraction and feeding of the cartridges in succession from the magazine.

As illustrates, the bolt 212 is redesigned to bottom out relative to a supporting and unmodified AR15 carrier 220, and as supported by the modified cam pin and slot configuration (from that known in the prior art) and as is depicted by the modified and reduced offset slot depicted by profile 268 as previously described and through which projects the bolt cam pin 200. By this configuration, the cam pin exhibits a minor degree of wiggle room and without the requirement that it contact the cam slot in order to accommodate the desired delayed rotational blowback functionality. Other features, such as the barrel extension 228 are depicted as previously shown.

Figure 8:
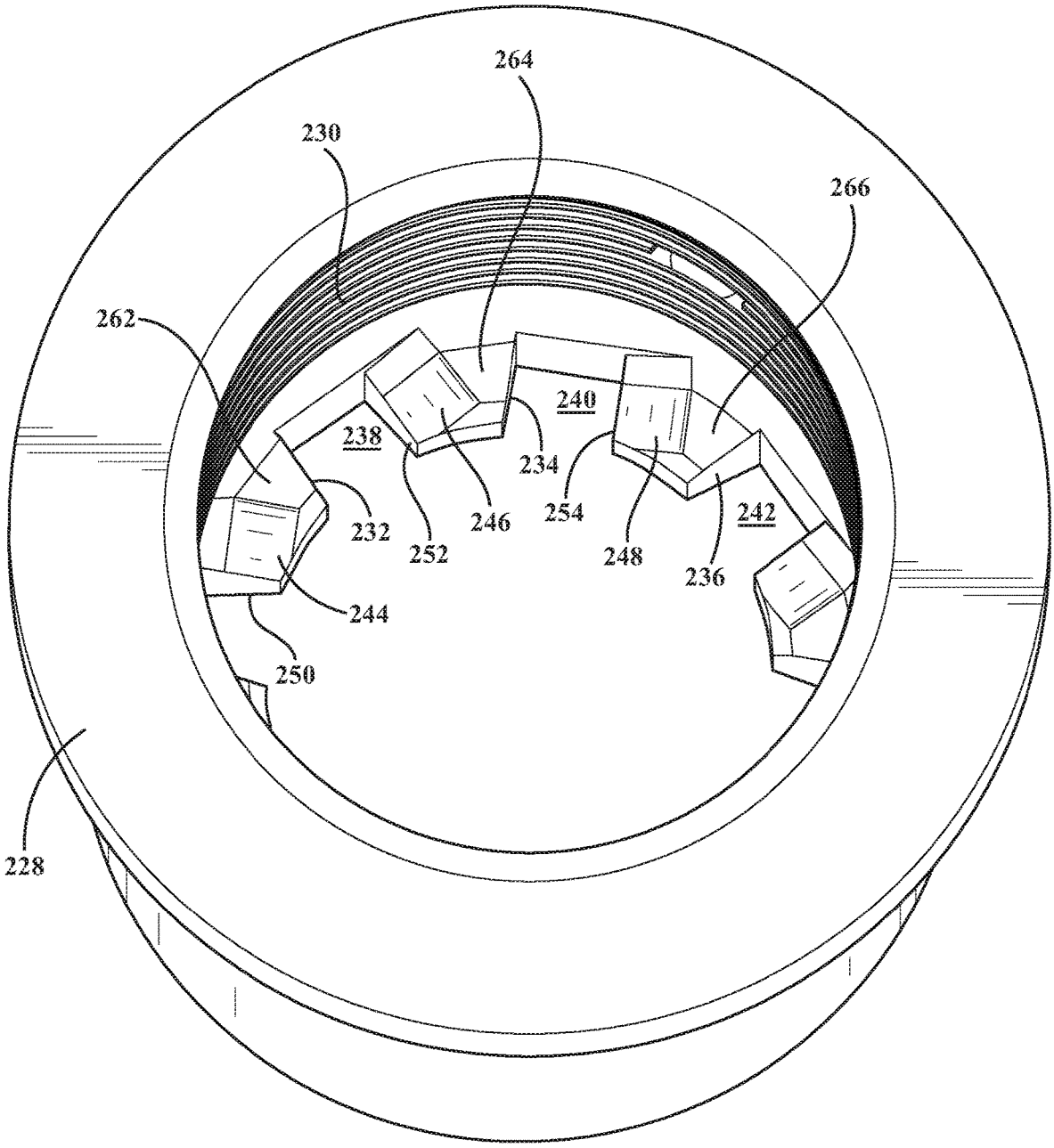
FIG. 8 is a perspective of an interior of a barrel extension having a reconfigured groove receiving pattern including inside surface chamfers for seating the leading edges of the bolt lug patterns during radial to longitudinal displacing motion in each of cartridge chambering and discharge directions.
Figure 9:
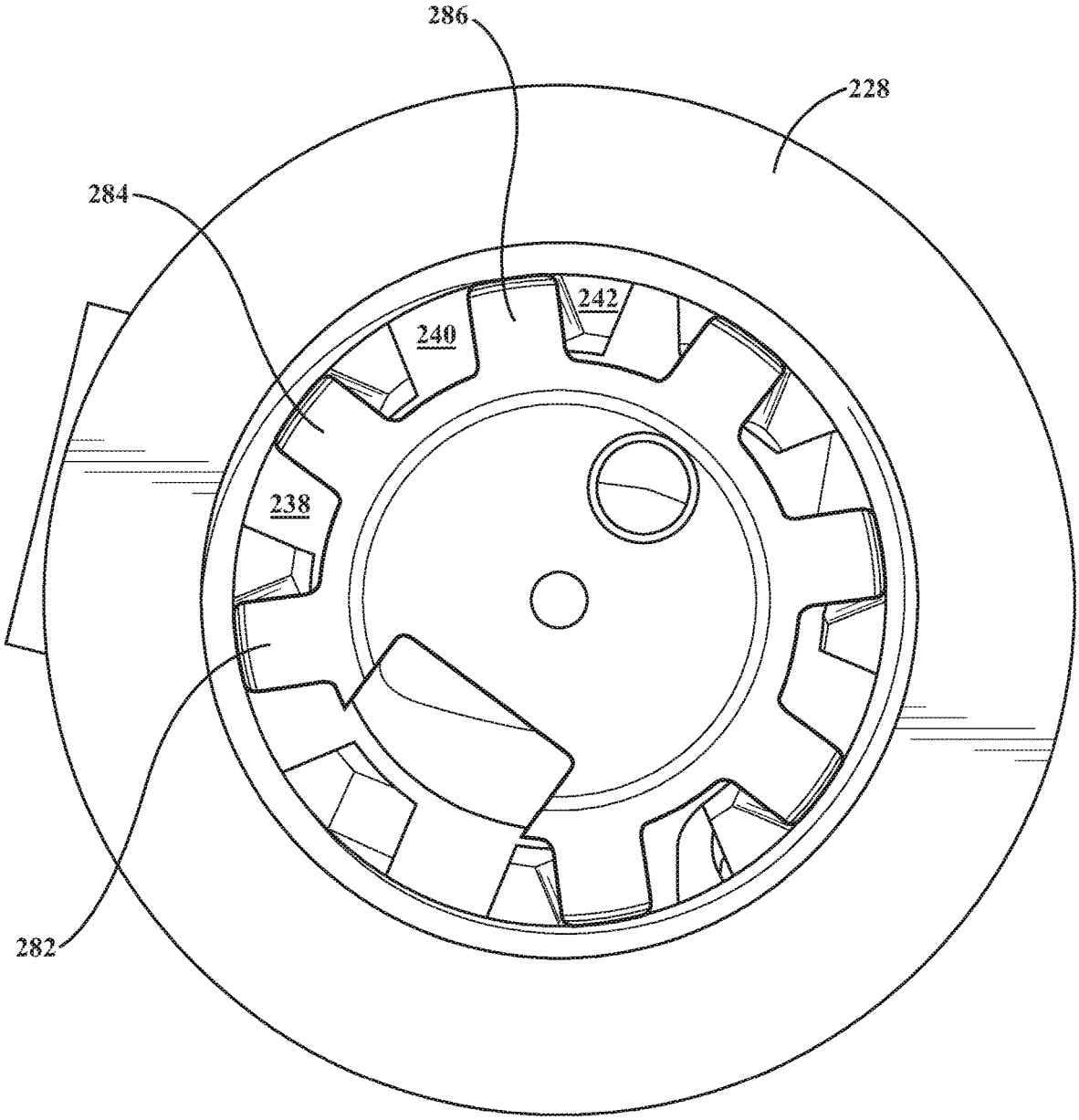
FIG. 9 is and end view in cutaway of the barrel extension in FIG. 8 and depicting a bolt lug pattern in an intermediate, overlapped and sliding inter-engagement with the chamfered surfaces configured upon the groove defining inward projections of the barrel nut, such occurring during contemporaneous rotation of the cam pin within the slot during motion of the bolt carrier group between chambering and discharge directions.
Figure 10:
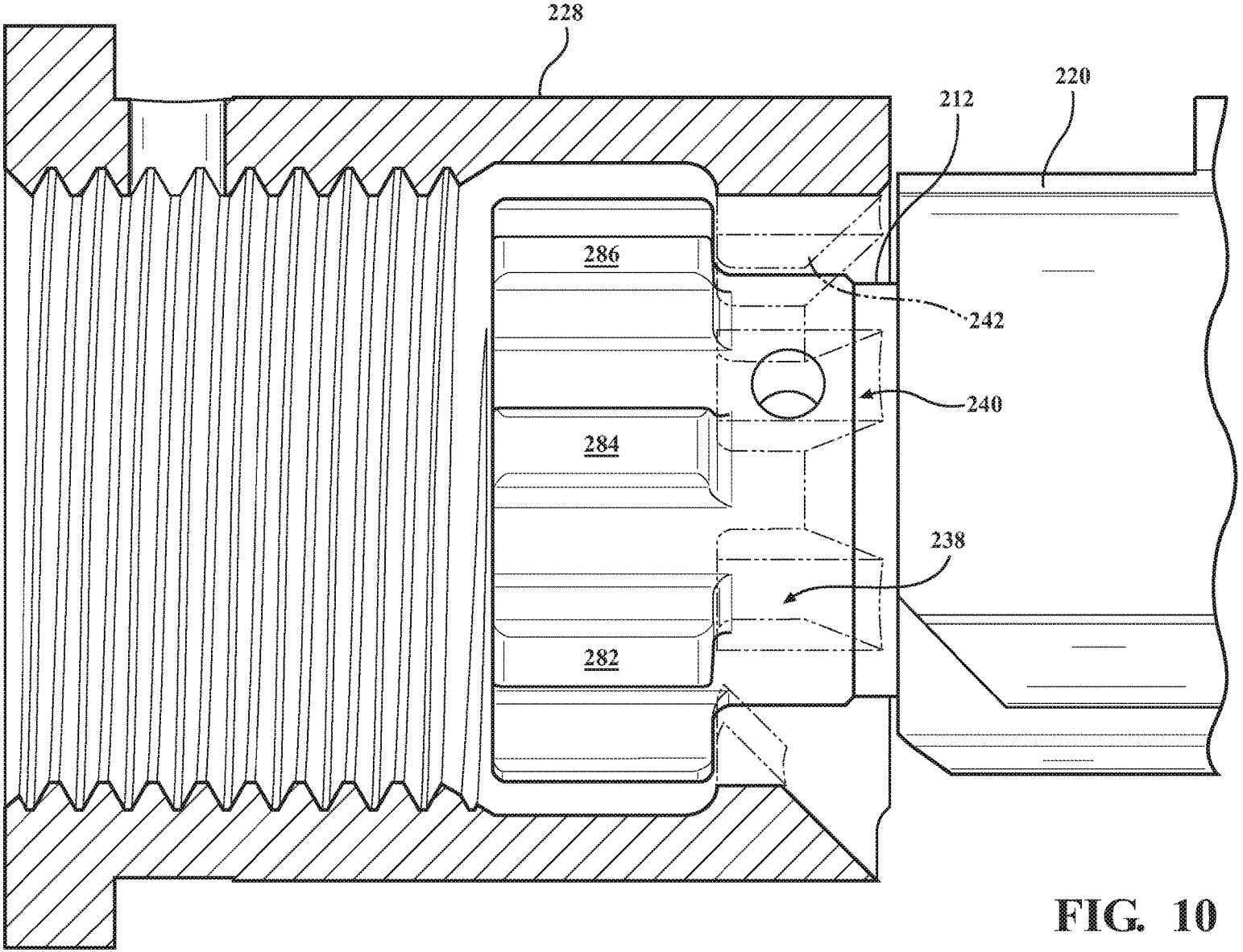
FIG. 10 is a lengthwise cutaway of a further modified barrel nut in which chamfers are configured along opposite contacting edges of the nut relative to the radially configured bolt lugs.
Figure 11:
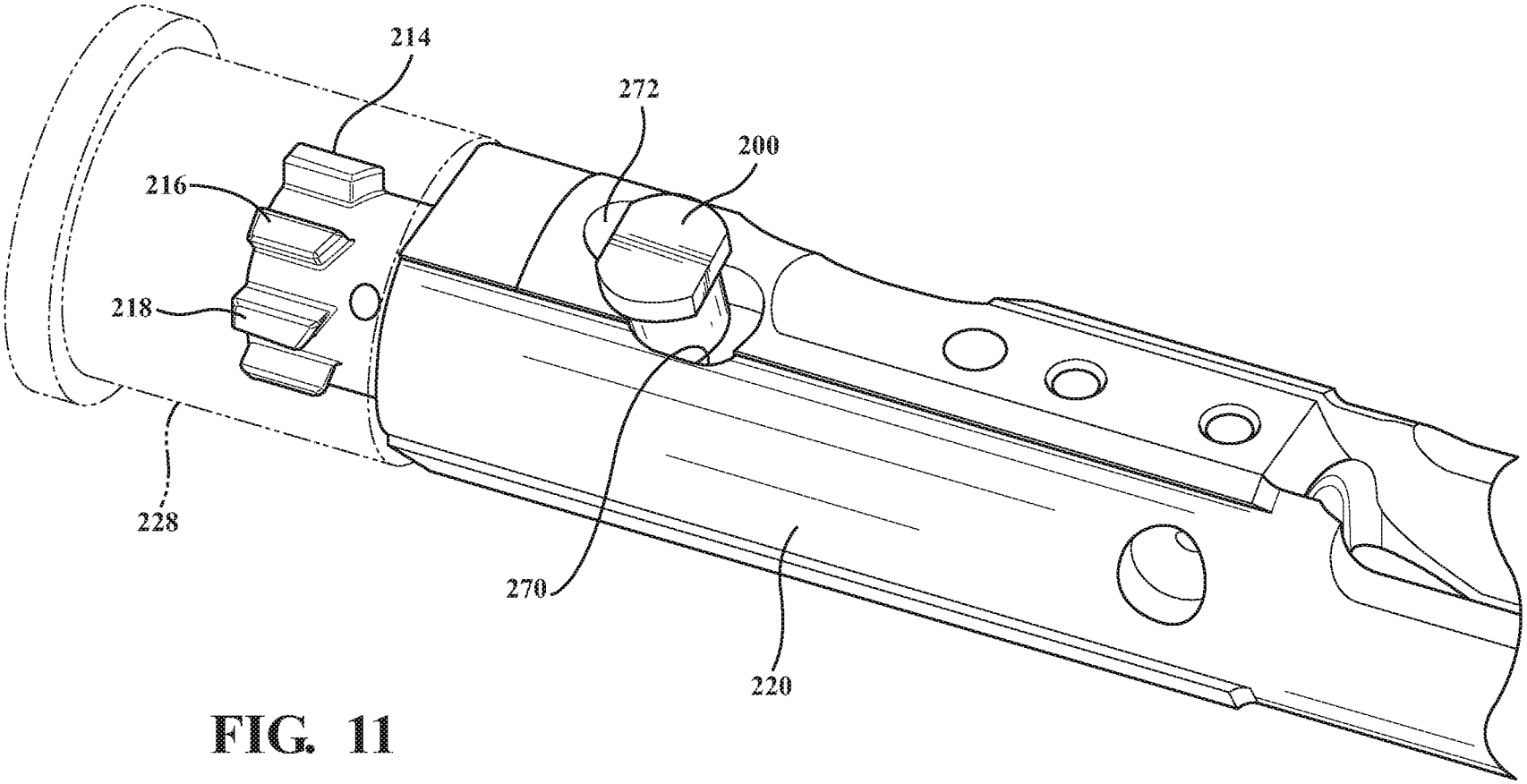
FIG. 11 is a perspective of the bolt carrier group and in which the bolt extending cam pin is depicted in an intermediate rotated position relative to the carrier configured slot and further depicting a forward chamfered edges associated with the bolt lug pattern similar to those depicted in FIGS. 1-3.

FIG. 9 presents an end view in cutaway of the barrel nut in FIG. 8 and depicting a bolt lug pattern (see again at 282, 284, 286, et seq.) in an intermediate, overlapped and sliding inter-engagement with the chamfered surfaces (see as previously depicted at 238, 240, 242, et seq.) configured upon the groove defining inward projections of the barrel extension, such occurring during contemporaneous rotation of the cam pin within the slot during motion of the bolt carrier group between chambering and discharge directions. FIG. 10 is a lengthwise cutaway of a further modified barrel extension in which chamfers are configured along opposite contacting edges of the extension relative to the radially configured bolt lugs, and FIG. 11 is a perspective of the bolt carrier group and in which the bolt extending cam pin is depicted in an intermediate rotated position relative to the carrier configured slot and further depicting a forward chamfered edges associated with the bolt lug pattern similar to those depicted in FIGS. 1-3;

As best shown in the end view of FIG. 10, depicted is a conventional pattern of radially projecting and circumferentially offset lugs, at 282, 284, 286, et. seq. (such not necessarily requiring the chamfer patterns previously described in FIGS. 1-3), and which, according to the aforementioned functionality, are displaced into abutting contact with the barrel extension pattern depicted by the radial inwardly defined and chamfered receiving nut grooves 238, 240, 242, et seq. (again FIG. 9). Upon being subsequently rotated in a slightly delayed and force-absorbing manner, as previously discussed (see also FIG. 10), the lug to groove chamfer interface results in the dissipation of a measured degree of the ejection force associated with the action assembly, again while still permitting completed cycling of the assembly in order to chamber a subsequent round utilizing the associated direct gas impingement assembly.

Figure 14:
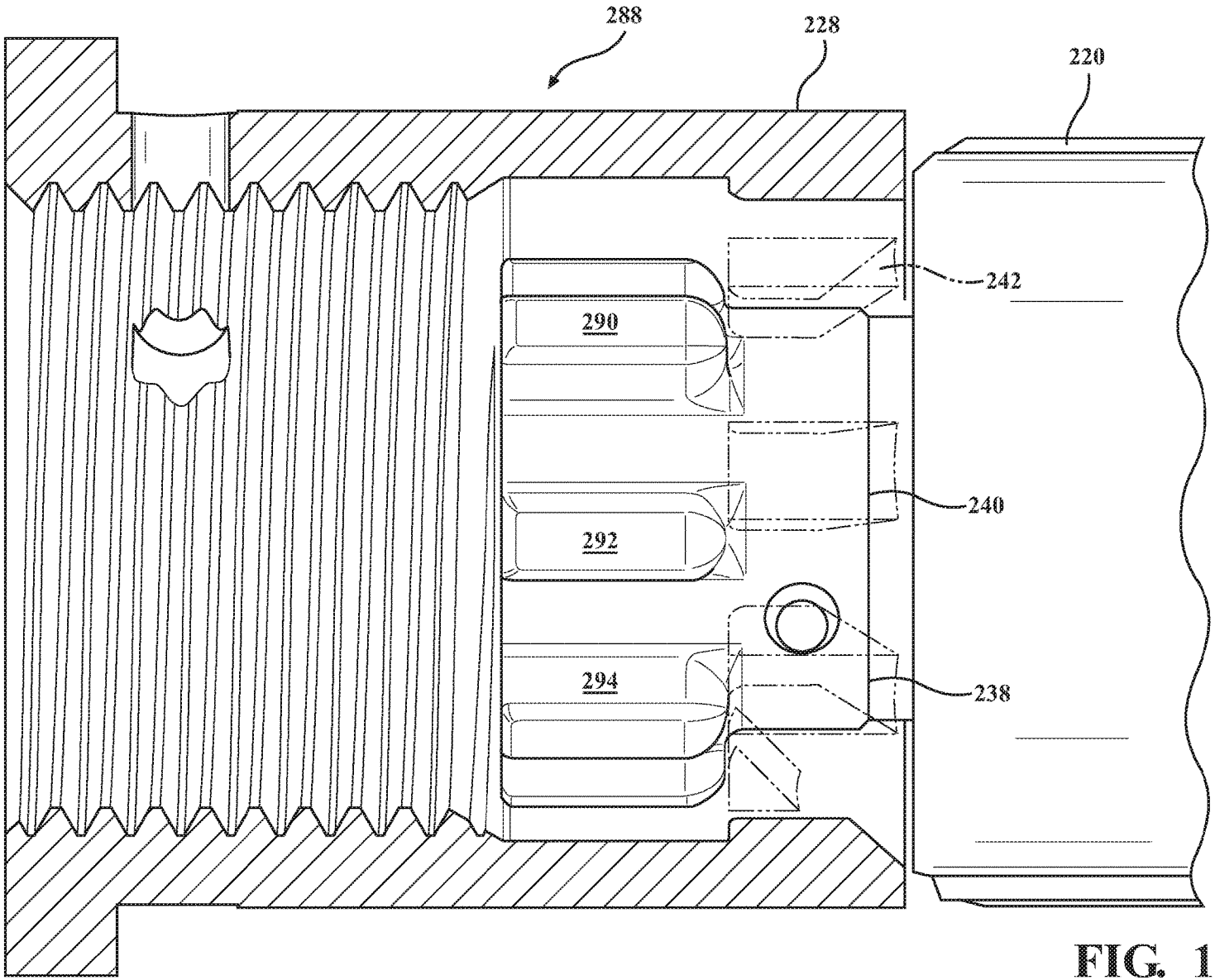
FIG. 14 is a lengthwise cutaway of a further modified barrel extension to bolt lug pattern seating interface and in which the lugs are rounded according to a further configuration in order to facilitate inter-rotational contact with a redesigned and mating groove receiving profile of the barrel nut.

FIG. 14 is a lengthwise cutaway of a further modified barrel extension, to bolt lug pattern seating interface, generally at 288, and in which a plurality of forward end disposed and radially outwardly directed lugs, at 290, 292, 294, et seq., are rounded according to a further configuration in order to facilitate inter-rotational contact with a redesigned and mating groove receiving profile (again at 238, 240, 242 et seq. as is previously shown in FIG. 10) of the barrel extension 228. When contacted by the opposing and linearly displacing bolt lugs, the groove profiles are caused to interact, with the chamfered (or ramped) edges causing rotation of the bolt in the manner which facilitates delayed rotational offset in the manner desired.

Figure 15:
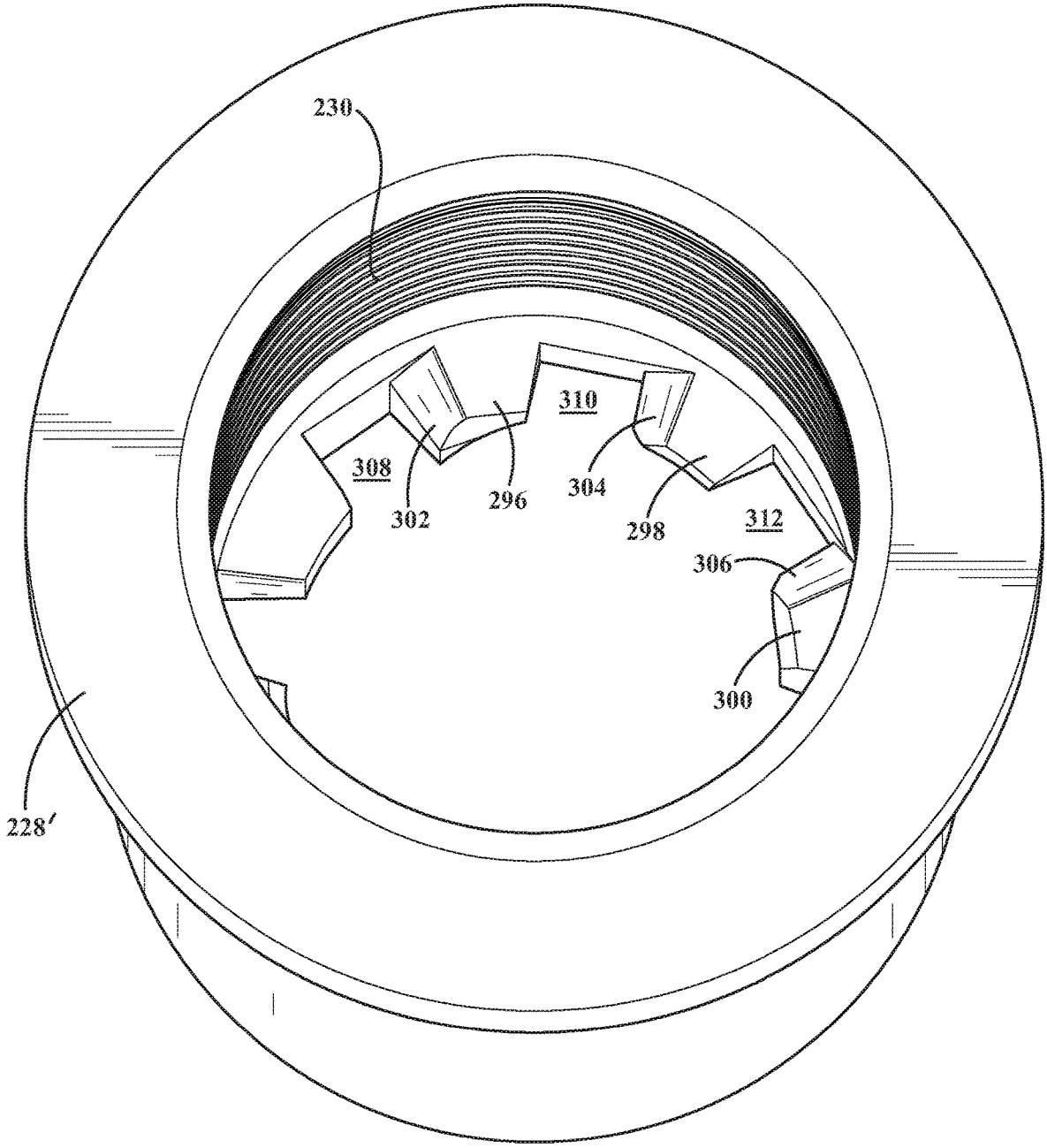
FIG. 15 is a perspective of an interior of a barrel extension having a further configuration, as compared to FIG. 8, and in which the inwardly projecting and groove defining portions of the barrel extension each exhibit an arcuate leading edge portion for facilitating inter-rotational contact with the opposing edge surfaces of the bolt lugs.

Proceeding to FIG. 15, a perspective illustration is shown of an interior of a barrel nut, at 228' as compared to FIG. 8, and in which the inwardly projecting and groove defining portions of the barrel nut, these being depicted at 296, 298, 300, et seq., with each exhibiting an arcuate leading edge portion, further at 302, 304, 306, et seq., (these varying from those previously shown at 244, 246, 248, et seq., in FIG. 8) for facilitating inter-rotational contact with the opposing edge surfaces of the bolt lugs (not shown). The chamfer profiles in the bolt lug grooves are positioned proximate radial passageways 308, 310, 312, et seq., and, similar to that shown in FIG. 8, each of the barrel extension inwardly projecting portions 296, 298 and 300 likewise include planar top end surfaces for fully seating the bolt lug in the fully chambered position.

Figure 16:
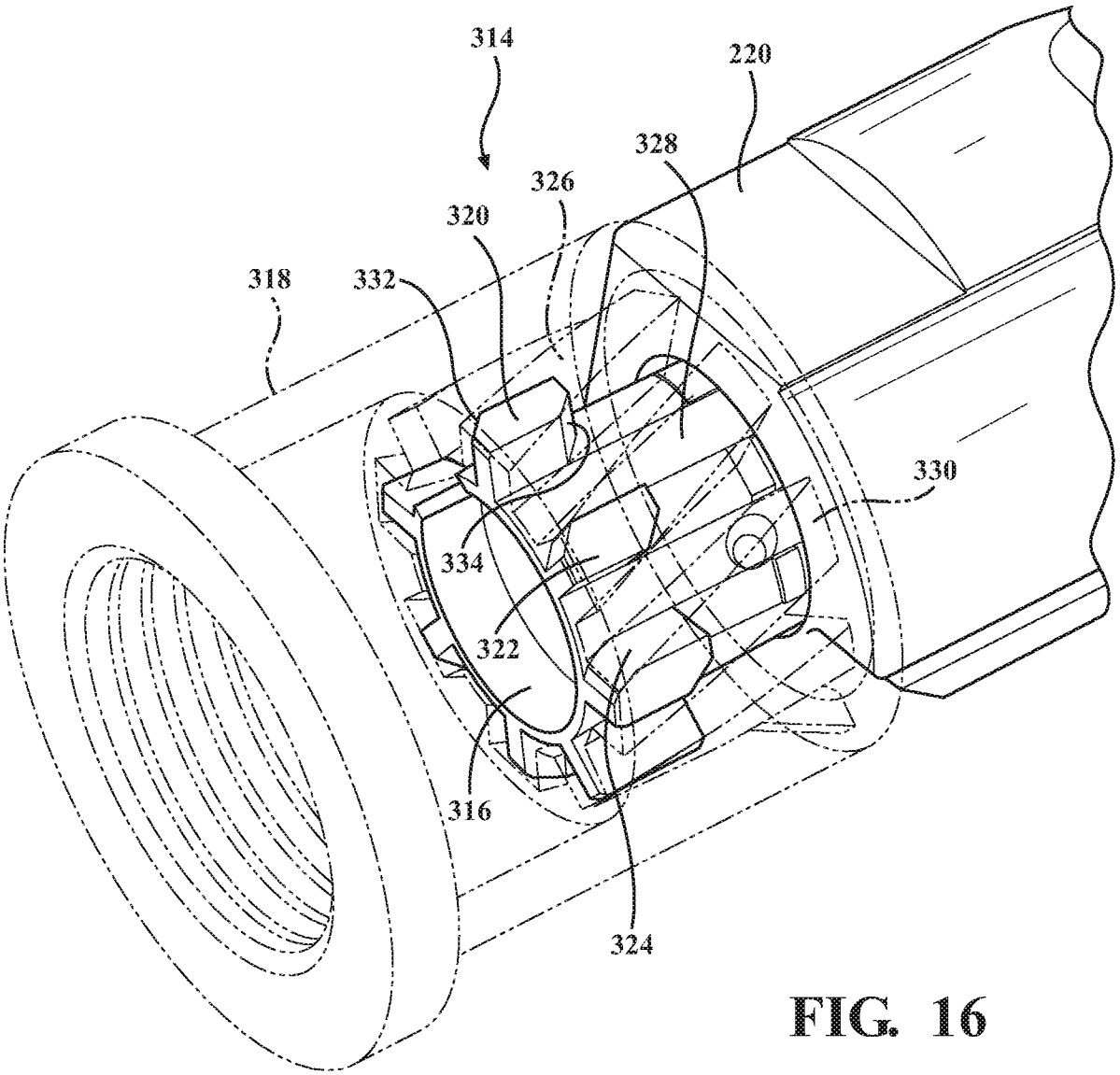
FIG. 16 is a partial perspective of a bolt exhibiting a further configuration of lug receiving patterns with pseudo-parallelogram shapes in profile and which are received within helically configured profiles defined within the receiver nut for providing continuation rotation of the lugs and bolt during linear translation across the contact zone defined between the lugs and receiver nut defined grooves.

FIG. 16 is a partial perspective, generally at 314, of a bolt 316 seated within a barrel extension, at 318 depicted in phantom. The bolt exhibits a further configuration of lug receiving patterns, each of these exhibiting a pseudo-parallelogram shape in profile, see at 320, 322, 324, et seq., and which are received within helically configured profiles, at 326, 328, 330, et seq., these defined within the receiver extension for providing continuation rotation of the lugs/bolt during linear translation across the contact zone defined between the lugs and the helically winding receiver nut defined grooves. This is further assisted by the opposite corner chamfered surfaces associated with each of the parallelogram lug shapes (see by example chamfer corners 332 and 334 for selected lug 320 which are guided along the sloping opposing inner surfaces of the selected helical groove 326). In one non-limiting application, and by narrowing the width of the locking lugs from that depicted in a standard AR15 construction, the bolt is allowed to rotate the standard 22.5° associated with cycling of the action assembly, this while still allowing the chamfered bolt lugs to overlap the inwardly projections of the barrel extension defining the grooves.

Figure 17:
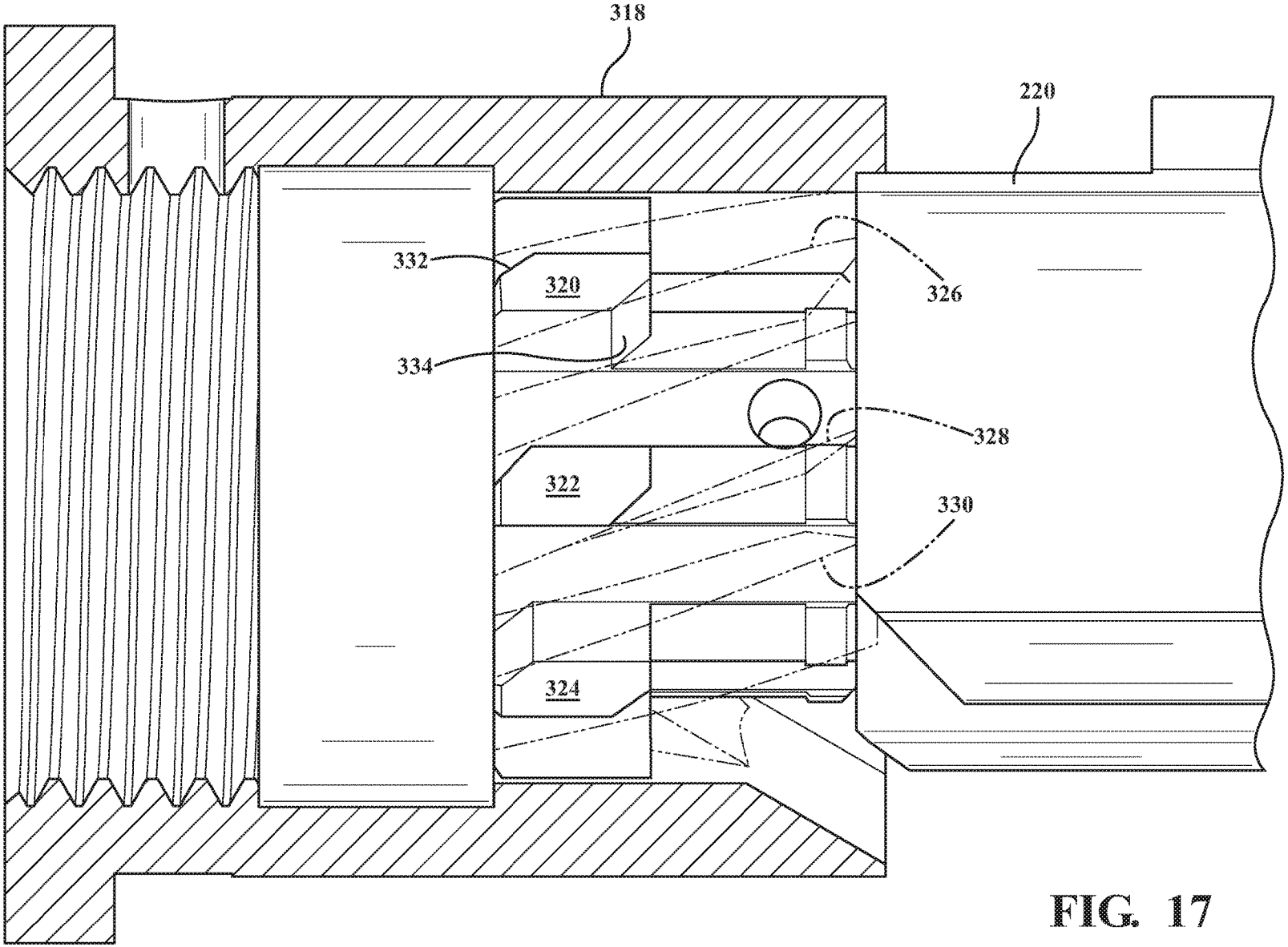
FIG. 17 is a plan view of the variant of FIG. 16 and better illustrating the helical winding of the interior grooves defined in the barrel nut.
Figure 18:
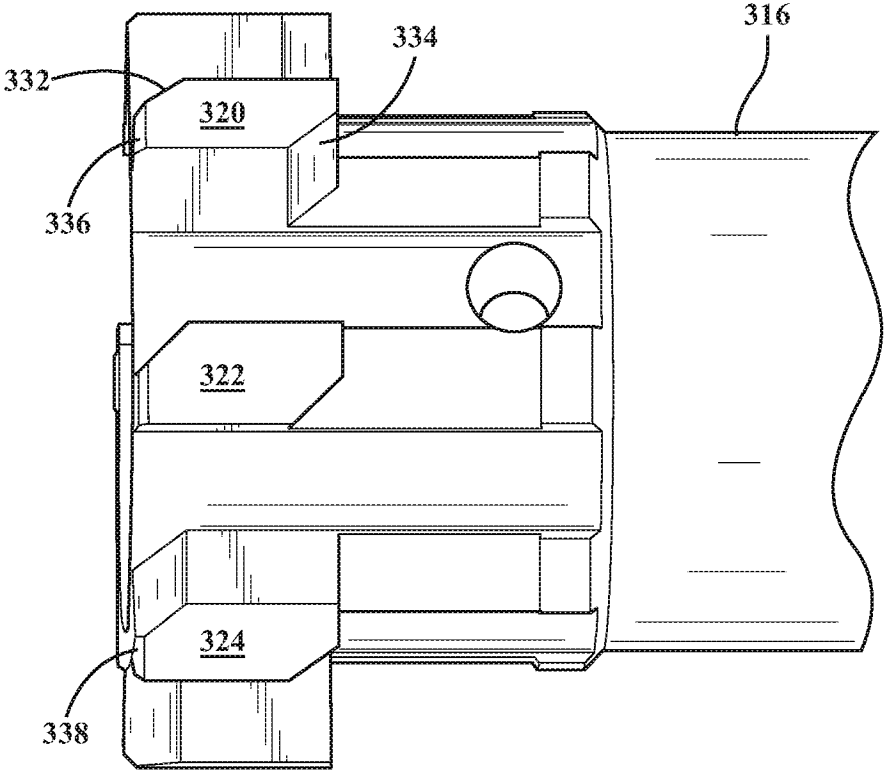
FIG. 18 is a side plan view of the forward most end of the bolt exhibiting the modified parallelogram lug pattern of FIG. 16.

FIG. 17 is a plan view of the variant of FIG. 16 and better illustrating the helical winding of the interior grooves 326, 328, 330, et seq., defined in the barrel extension 318. FIG. 18 is a side plan view of the forward most end of the bolt exhibiting the modified parallelogram lug pattern of FIG. 16, each of these views again illustrating the three dimensional parallelogram shaping of the bolt lug patterns. As further shown in FIG. 18, the lugs 320, 322, 324, et seq., can each further include a further top corner chamfer (see at 336 for lug 320 and at 338 for lug 324) and which can further be guided along a bottom cross sectional edge profile of each helical groove. Without limitation, the helical grooves 326, 328, 330, et seq. can exhibit a plurality of perpendicular interconnected surfaces as best shown or can include varied cross sectional profiles not limited to circular, arcuate or the like (such as with subsequent reference to FIG. 20).

Figure 19:
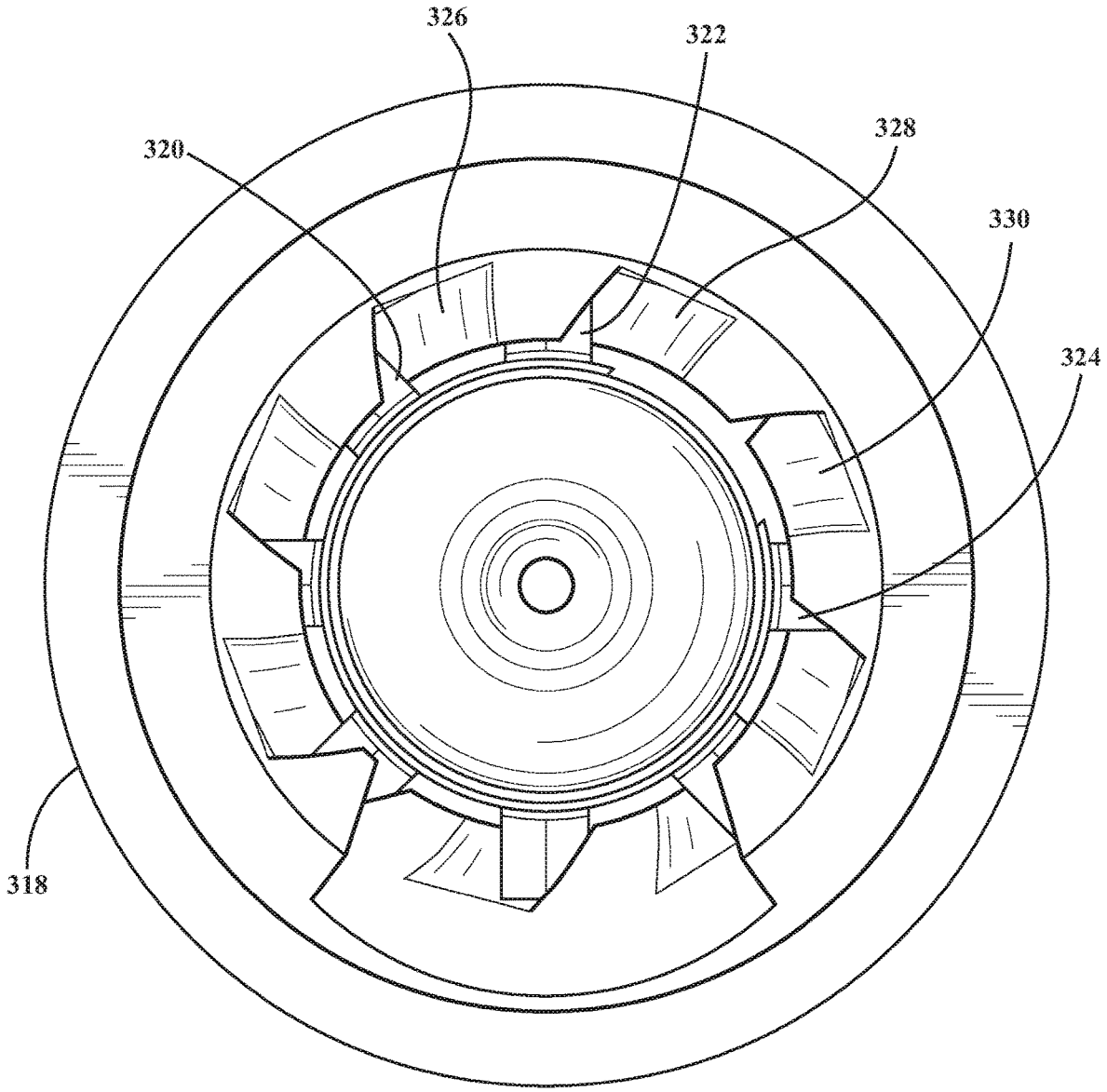
FIG. 19 is an interior cutaway end view similar to FIG. 9 depicting the reconfigured bolt lug pattern of FIG. 16 in an intermediate, overlapped and sliding inter-engagement with the helically configured and groove defining inward profiles of the barrel nut, such again which can occur during contemporaneous rotation of the cam pin within the slot during motion of the bolt carrier group between chambering and discharge directions.
Figure 20:
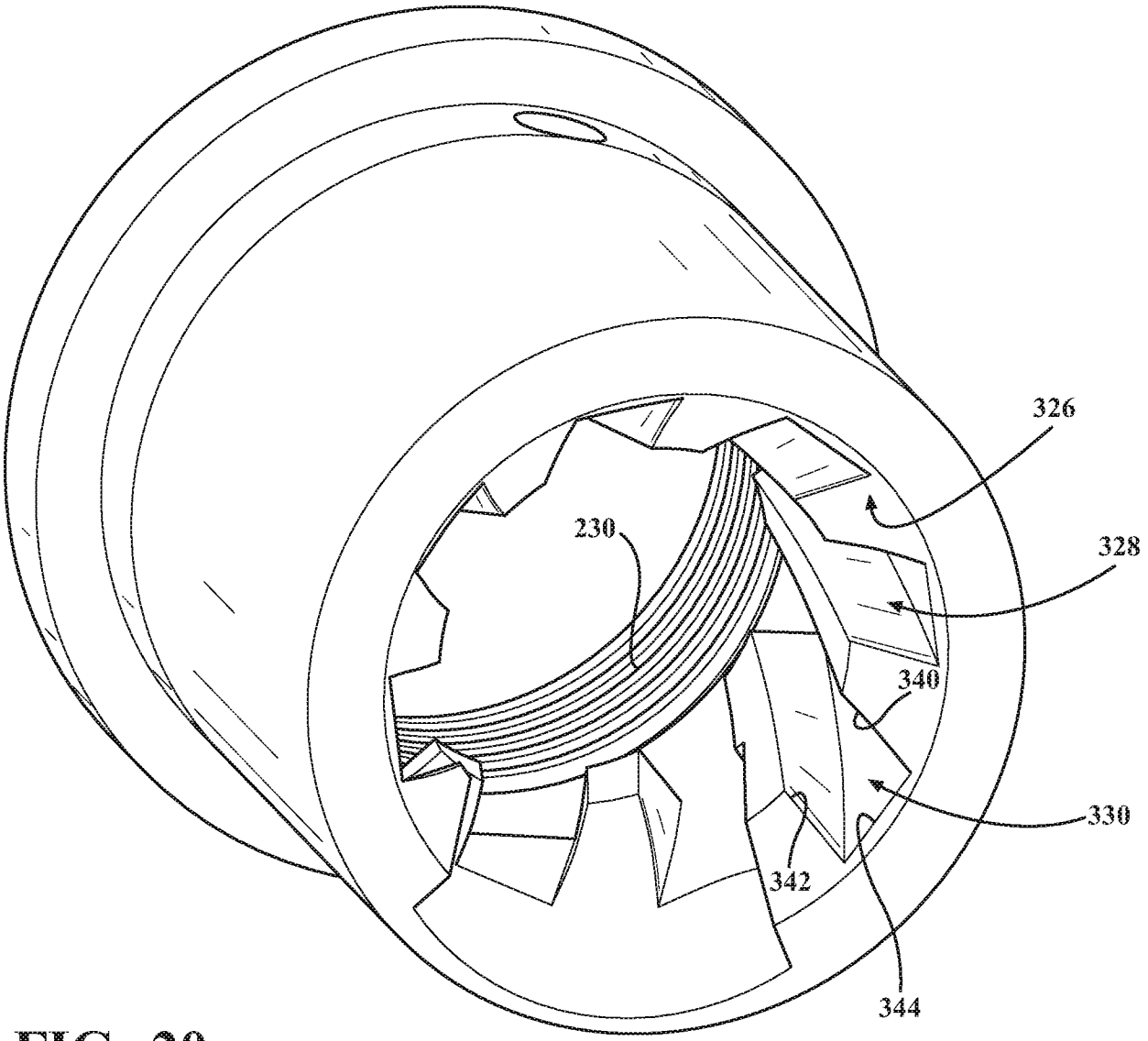
FIG. 20 is a rear end perspective of the barrel nut of FIG. 16 and depicting from another angle the helical patterning of the inner defined grooves.

Proceeding to FIG. 19, an interior cutaway end view is shown similar to FIG. 9 depicting the reconfigured bolt lug pattern of FIG. 16 in an intermediate, overlapped and sliding inter-engagement with the helically configured and groove defining inward profiles of the barrel extension, such again which can occur during contemporaneous rotation of the cam pin 200 within the slot 268 during motion of the bolt carrier group between chambering and discharge directions. FIG. 20 is a rear end perspective of the barrel extension of FIG. 16 and depicting from another angle the cross sectional profiles associated with the helical patterning of the inner defined grooves 326, 328, 330, et seq., such again including any cross sectional patterning and which, as depicted, includes sloping side surfaces (see at 340 and 342 for selected helical groove 330) which interconnect with a bottom most surface 344. In this fashion, the diagonally opposite corner chamfers 332 and 334 of the lugs (see at 320 in FIG. 18) are guided along the sloping sides 340 and 342, with the further outer edge chamfer 336 contacting the interconnecting bottom most recessed surface 344 of the associated helical groove. In this manner, the rotational to linear converting interface between the barrel lugs and helical grooves influences the desired rotary force absorbing motion between the bolt and the barrel extension in order to again "tune" a desired degree of force dissipation therebetween, this while still retaining sufficient gas impingement discharge momentum to allow for complete cycling of the action assembly.

Figure 21:
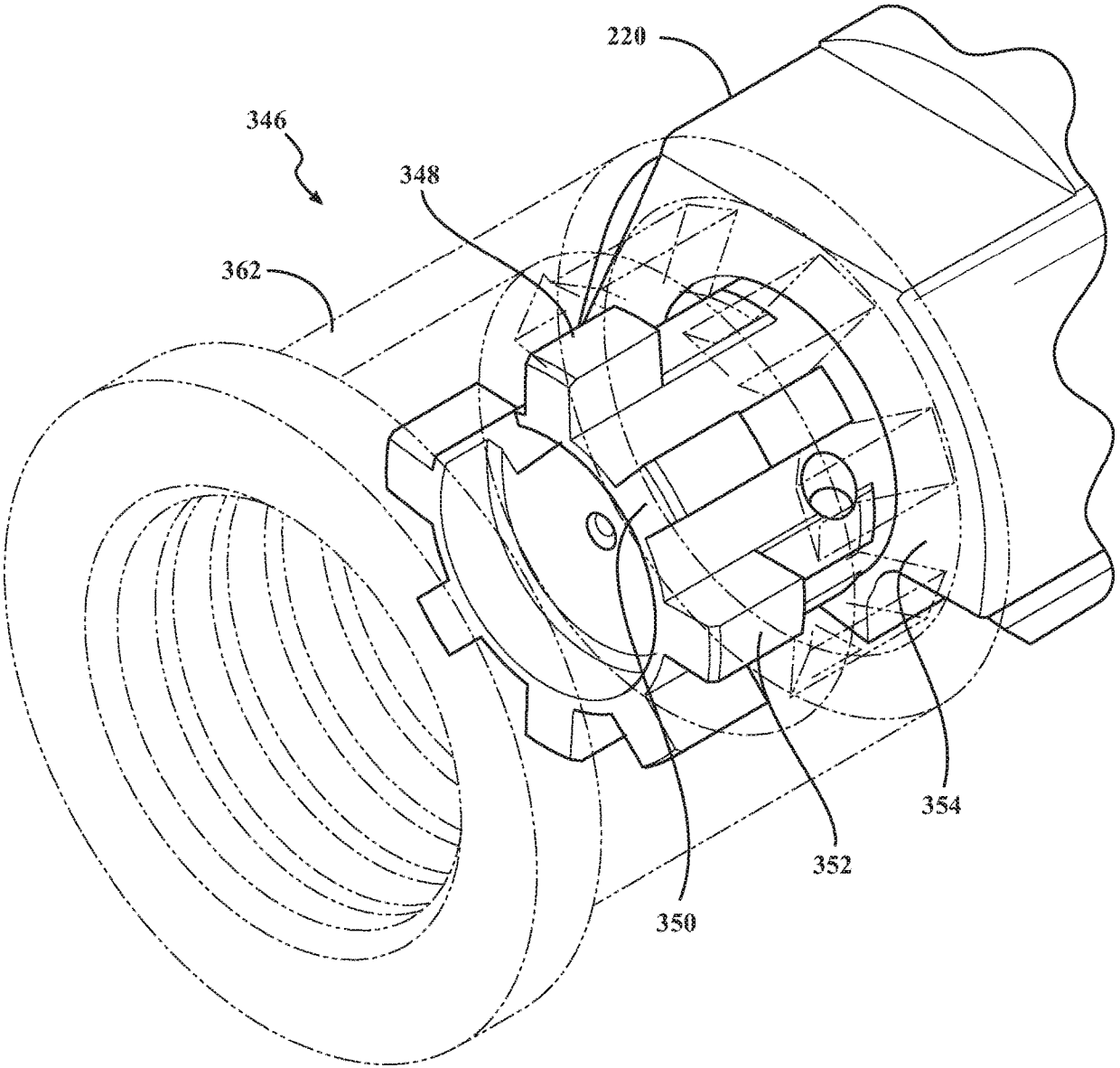
FIG. 21 is a perspective view of a further version of a bolt having a linearly shortened array of radially projecting lugs for facilitating an initial and unimpeded rearward motion of the bolt before contacting the barrel extension, such imparting sufficient momentum into the carrier so that its continued displacement causes rotation of the cam pin and bolt to the rotated position via the top surface configured channel in the carrier through which the cam pin projects.
Figure 22:
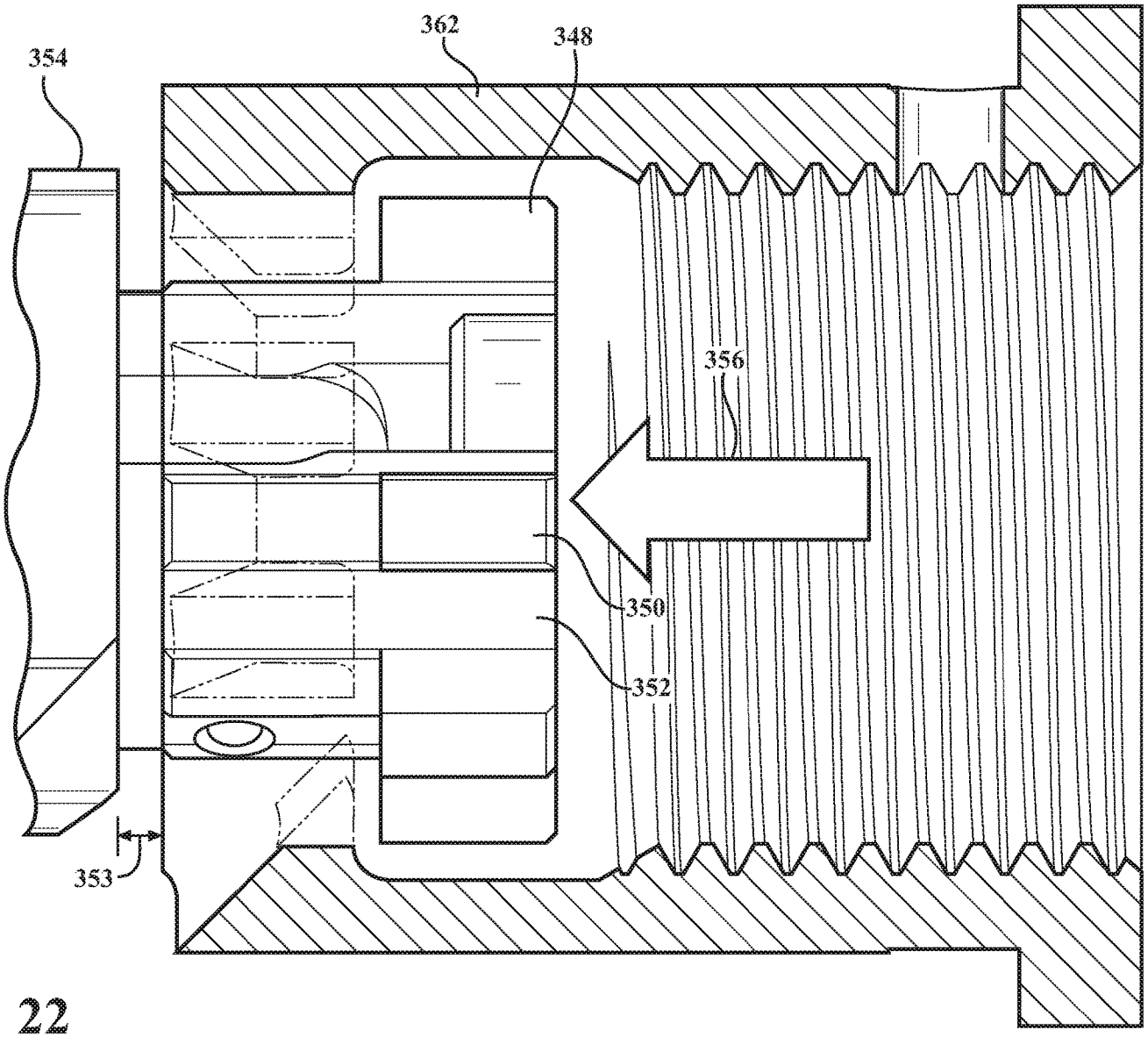
FIG. 22 illustrates a plan view of the shortened lug version of FIG. 21 in which the bolt lugs experience an initial rearward unimpeded motion at the start of the cartridge discharge cycling sequence.

FIGS. 21-26 collectively illustrate a sequence of operation of a further variant, generally at 230 in FIG. 21, of a bolt a linearly shortened array of radially projecting lugs for facilitating an initial and unimpeded rearward motion of the bolt before contacting the barrel extension, such imparting sufficient momentum into the carrier so that its continued displacement causes rotation of the cam pin and bolt to the rotated position via the top surface configured channel in the carrier through which the cam pin projects. FIG. 21 is a perspective view of a further version of a bolt, generally at 346, and having FIG. 22 illustrate a plan view of the shortened lug version of FIG. 21 in which a plurality of radially disposed bolt lugs, depicted at 348, 350, 352 et seq., are dimensioned to exhibit a shorter linear dimensional as compared to those depicted in prior variants FIGS. 1, 10 and 14. As further best shown in FIG. 21, the bolt lugs in the depicted variant are three dimensional rectangular with slightly rounded edges however, and as per the preceding embodiments, can also be provided with any desired curvature or chamfer. Further, and owing to the shortening of the length dimension, the bolt, at 354, experiences an initial rearward unimpeded motion at the start of the cartridge discharge cycling sequence, this further being shown at 356 in FIG. 22 and by which lugs 348, 350, 352, et seq. are caused to displace linearly along associated grooves 358, 360, et seq. (FIG. 23) associated with a barrel extension, at 362.

Figure 23:
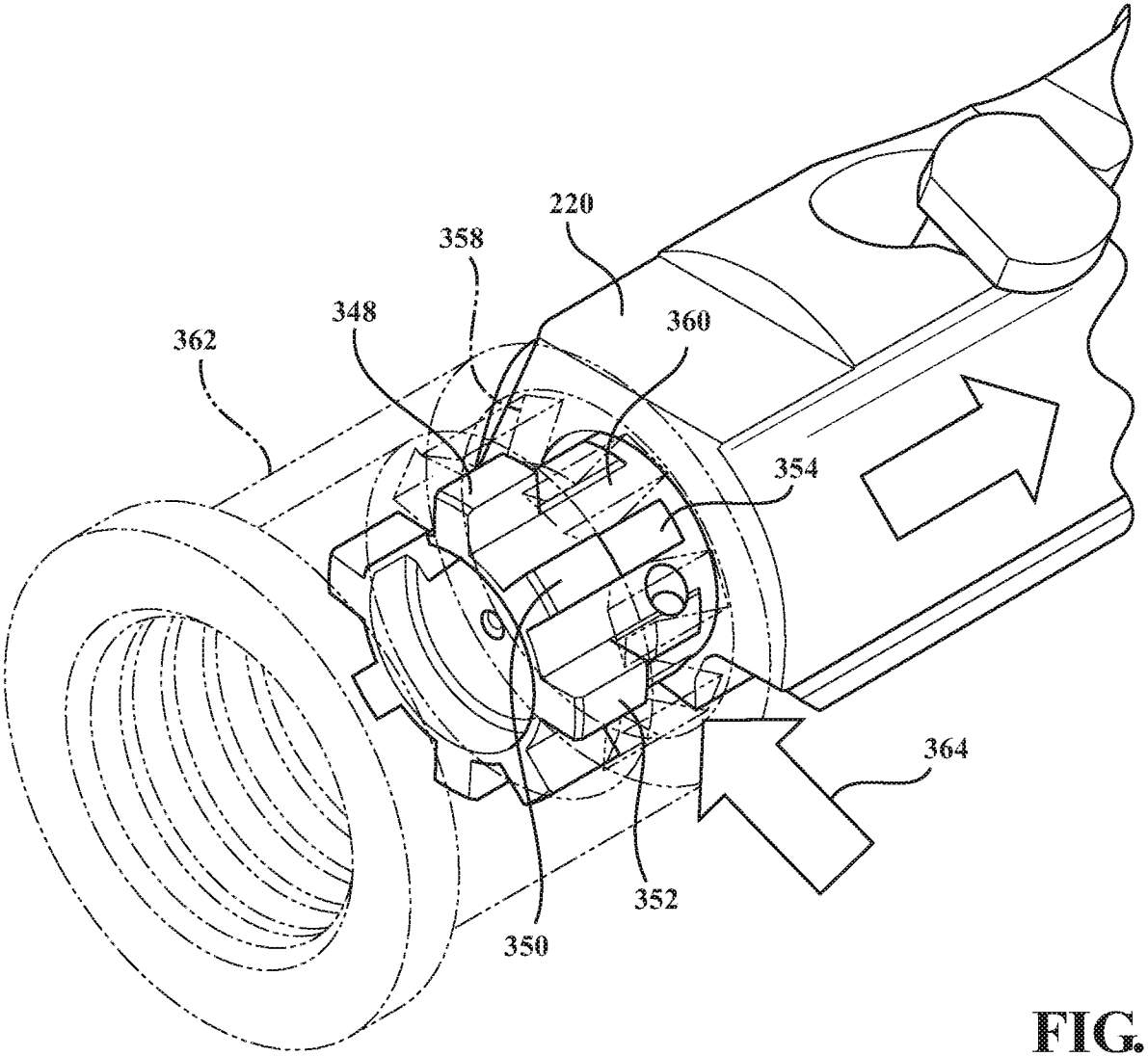
FIGS. 23-24 illustrate contemporaneous perspective and plan views of the shortened bolt lugs contacting the barrel extension, with the bolt stopping its independent rearward motion and the surrounding carrier continuing rearward motion.

In this fashion, the reconfigured bolt 354 and, subsequently, the supporting carrier 220 are caused to axially displace rearwardly, relative to the interior of the barrel extension 362, and in the direction of arrow 356 (again FIG. 22), this in response to the force of discharge of the cartridge being fired. FIG. 23 depicts, from a partially phantom iso-perspective view, in intermediate position in which barrel extension 362, via its interior receiving patterns 358, 360, et seq., contacts and seats with the shortened annular lug pattern 348, 350, 352, et seq. and interrupts further rearward displacement of the bolt 354 (further reference being made to directional arrow 364).

Figure 24:
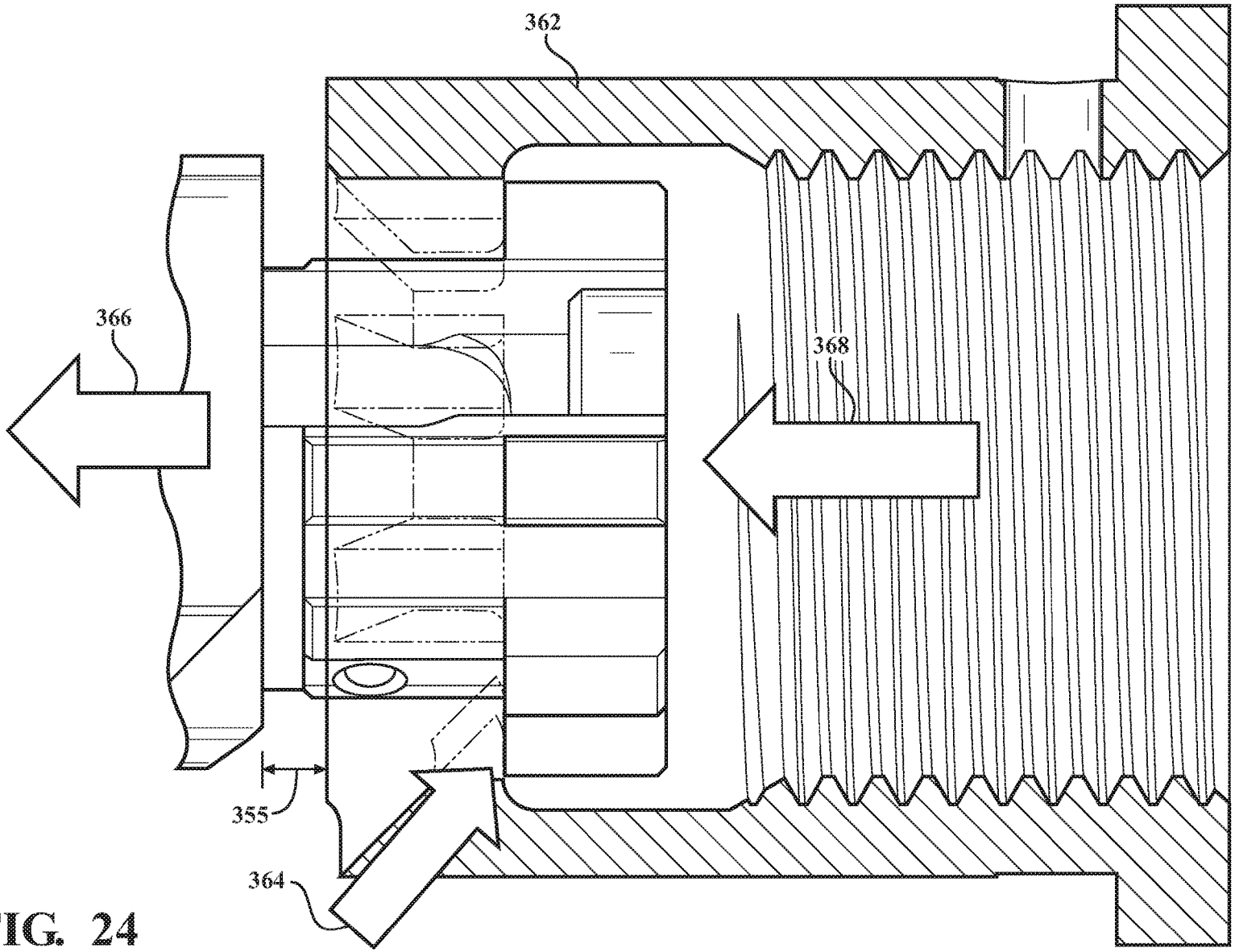
Figure 25:
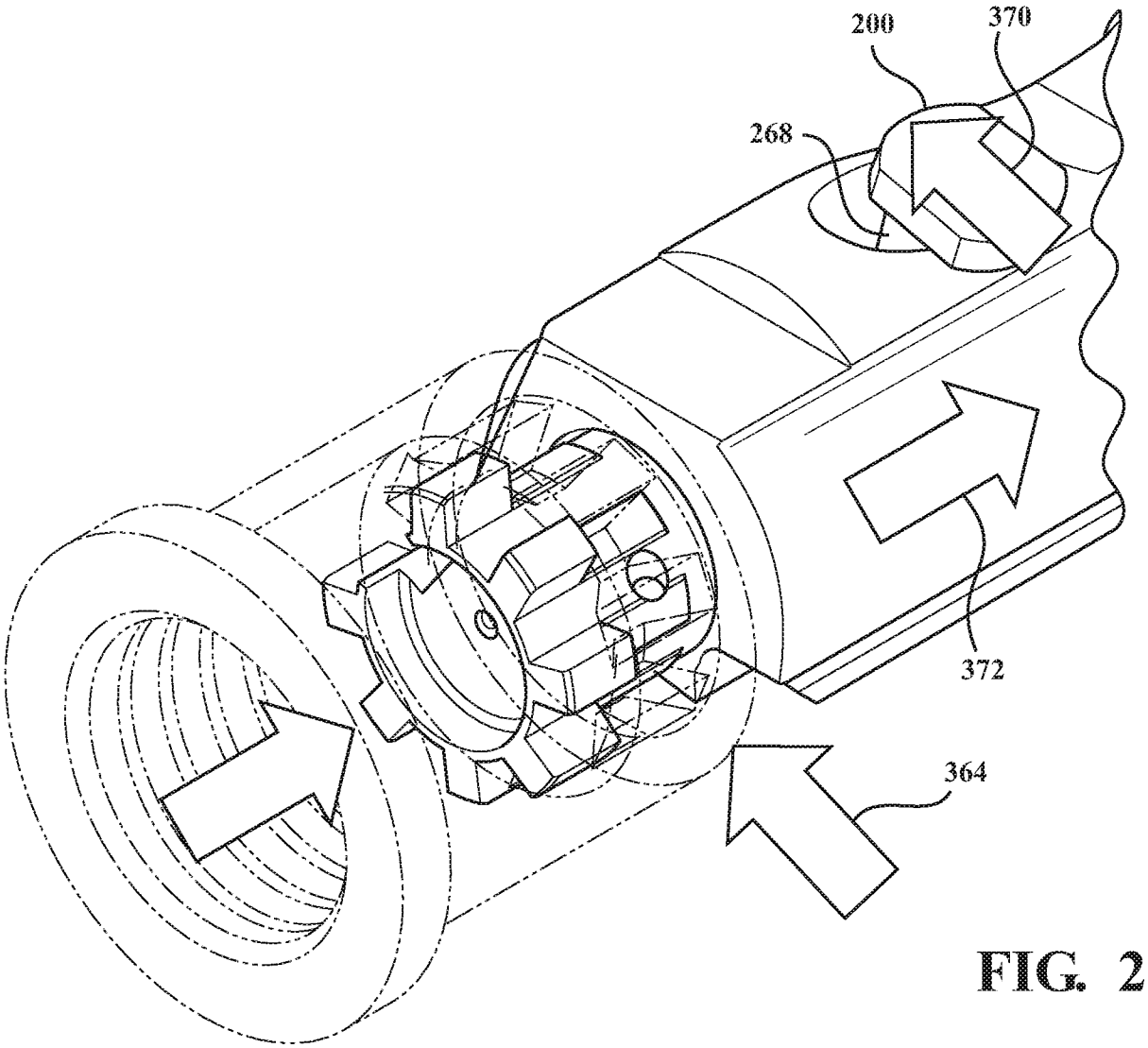
FIG. 25 is a perspective view progressing from FIG. 2 illustrates the carrier camming the bolt to rotate and unlock in a further intermediate portion of the radial delayed blowback discharge.

At this point, as is further shown in FIG. 24, and following interruption/stopping of the bolt travel (again depicted by engagement detail arrow 364 between the lug patterns on bolt and the receiving patterns on barrel extension interior, as well as by the dimensional spacing between the barrel receiver 354 and the opposing end face of the carrier 220 and as is depicted by dimension 353 in FIG. 22 and further dimension 355 in FIG. 24 which establishes the initial unobstructed range of bolt displacement away from the receiver nut and prior to end surfaces of the lugs contacting the receiver grooves), the carrier 220 continues in its rearward displacement, this shown by arrow 366, resulting from the concurrently directed cartridge discharge force 368. FIG. 25 depicts the continued motion of the carrier 10 resulting in the engaging contact established between the cam pin 200 and the arcuate slot (again defined by perimeter extending inner wall 268) configured within the carrier 220 upper surface.

At this point, the carrier 220 cams the bolt 354 to rotate and unlock in a further intermediate portion of the radial delayed blowback discharge cycle. As previously described, the cam pin engages the bolt 354 and, in response to the continued rearward displacement of the carrier 220, causes the bolt to rotate in the direction of arrow 370 as indicated by the cam pin 200 (i.e. rotation from position 270 to rotated position 272 as indicated in previous embodiment FIGS. 1-3.

Figure 26:
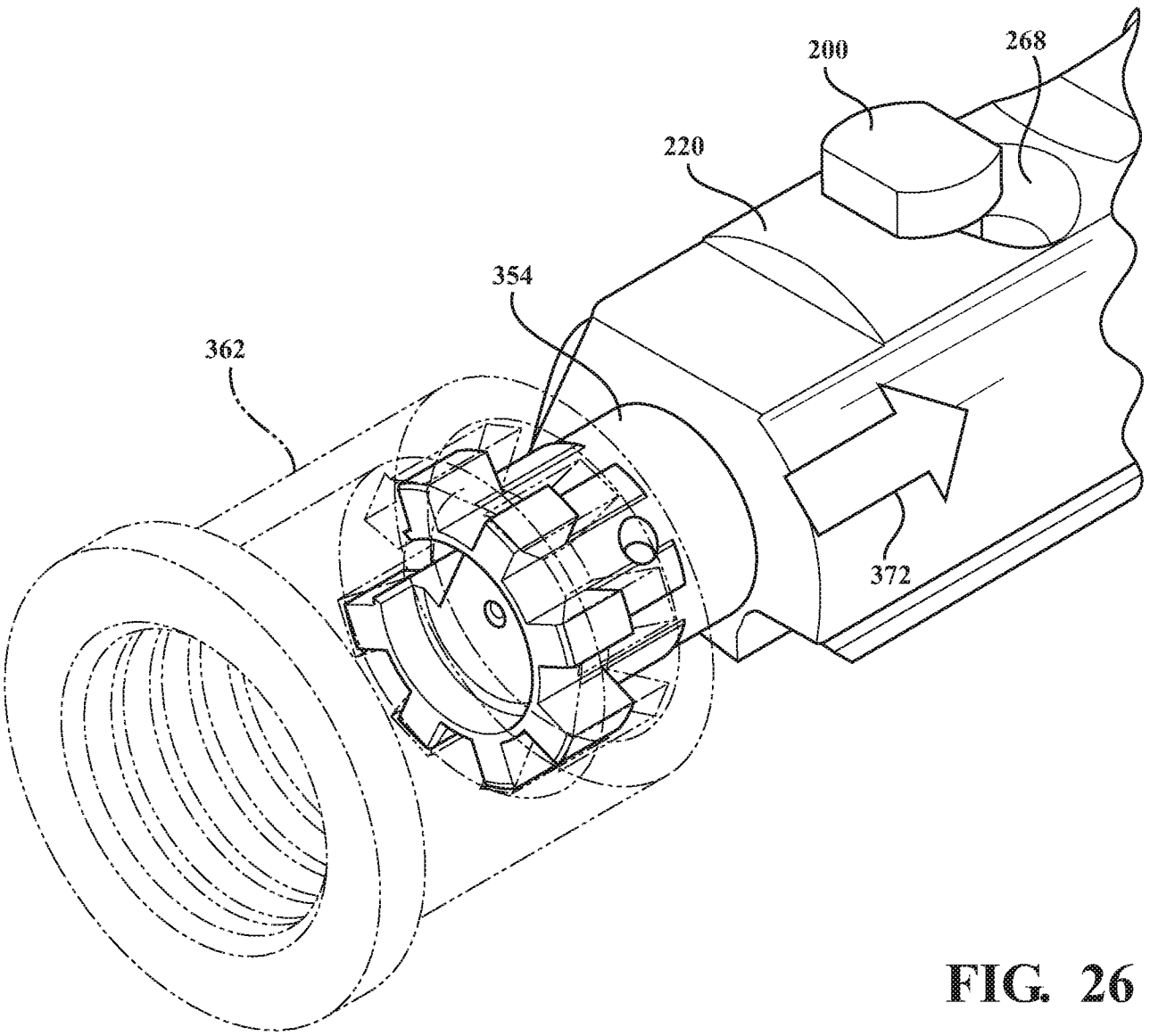
FIG. 26 illustrates a completion of the initial rearward displacement motion sequence of the carrier discharge cycle at which the carrier is released from the barrel receiver and in order to fully cycle rearwardly and, following return bias exerted by the buffer and spring, for return chambering a succeeding cartridge according to the action cycle previously described.

FIG. 26 illustrates a completion of the initial rearward displacement motion sequence of the carrier discharge cycle at which the carrier 220 is released from the barrel receiver extension 362 and in order to fully cycle rearwardly (see directional arrow 372) and, following return bias exerted by the buffer and spring, for return chambering a succeeding cartridge according to the action cycle previously described. At this point, the discharge sequence is completed, at which point the counter forces exerted by the gas tube reset the bolt to the fully rotated battery position of FIG. 42.

By this design, the gap established between the end faces of the bolt lugs 348, 350, 352, et seq., and the barrel extension 362 receiving pattern (in the closed position), facilitates an initial and unimpeded rearward motion of the bolt before contacting the barrel extension, such imparting sufficient momentum into the carrier to open the bolt and cycle the action substantially according to standard operation of an AR15 action assembly and by which the carrier causes the resulting discharge/cycling rotation. It is also understood that the configurations of either or both the barrel lugs and barrel extension receiving grooves can exhibit any pattern or contour, this also including any desired chamfer or patterning to provide any of the desired radial blowback functionality over the course of the reduced range of radial tuned blowback during rotation of the bolt within the carrier (FIGS. 24-26).

Additional envisioned features of the present inventions also include reconfiguring the bolt lug to barrel extension groove interface to exhibit any truncated or limited cam path established therebetween, this in order to provide additional modification or "tuning" of the radial delayed blowback function and in order to provide the desired attenuated recoil characteristics while still enabling generation of adequate recoil force for accomplishing return action of the assembly as per the previously described structure.

Figure 27:
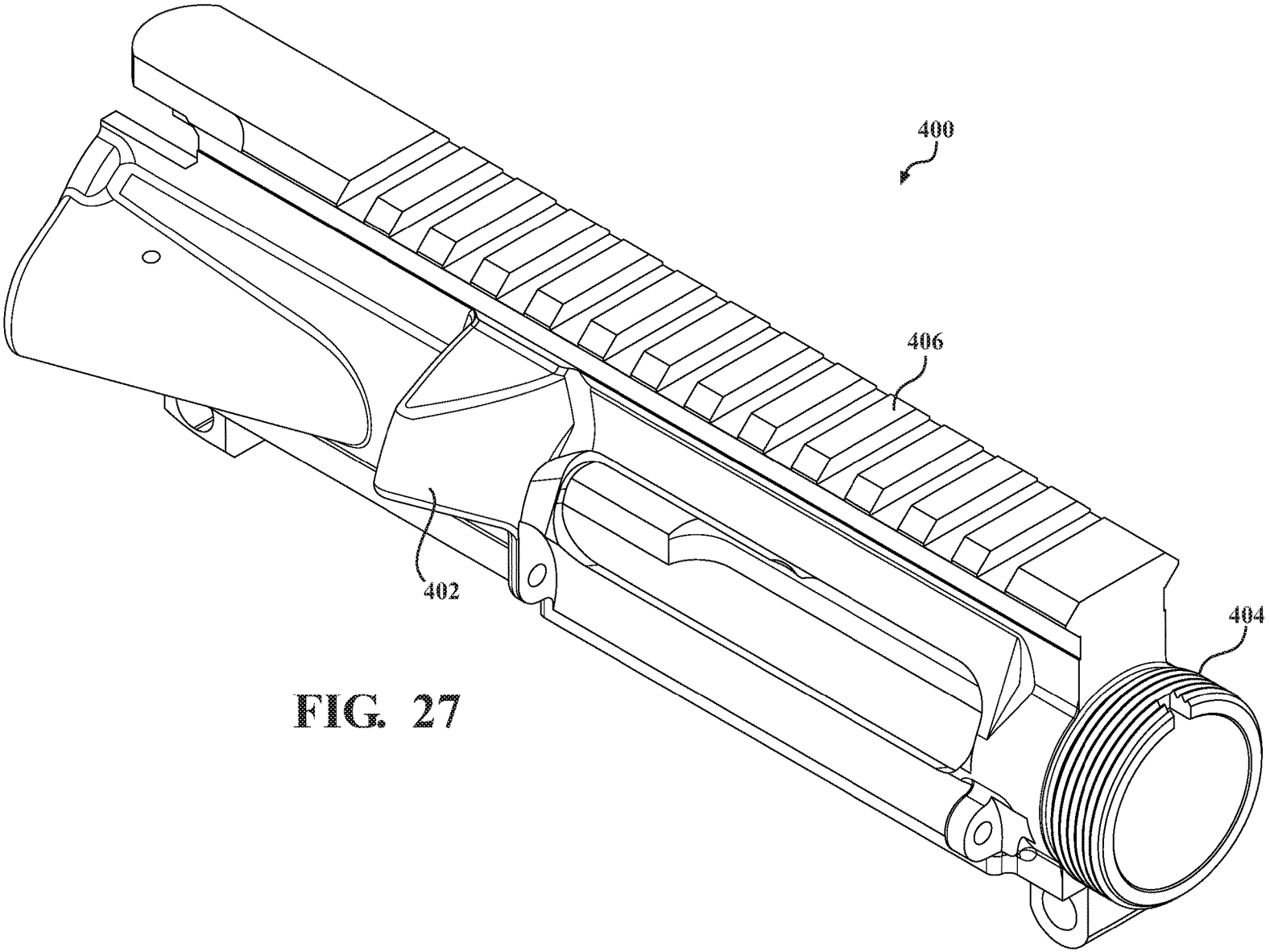
FIG. 27 is an illustration of an upper receiver component with either attachable or built-in trunnion component.

Proceeding to FIG. 27, an illustration is generally provided at 400 of an upper receiver component 402 which is generically depicted however is understood to include any of a receiver lug pattern integrated directly into the upper receiver (FIGS. 28-30) for engaging the mating exterior array of bolt lugs (the description of which is reiterated from each of the preceding embodiments), as well as incorporating any suitable trunnion component (examples of which are further depicted with reference to FIGS. 31-32 and FIGS. 33-34. Also depicted in FIG. 27 is a barrel nut 404 for threadably receiving an opposing and inter-engaging threaded end of a firearm barrel (such as previously depicted again in FIG. 5) and an upper mounted rail 406. Other features, such as including the bolt carrier group with bolt and supporting carrier are again referenced in the preceding figures and install within the upper receiver component 402.

Figure 28:
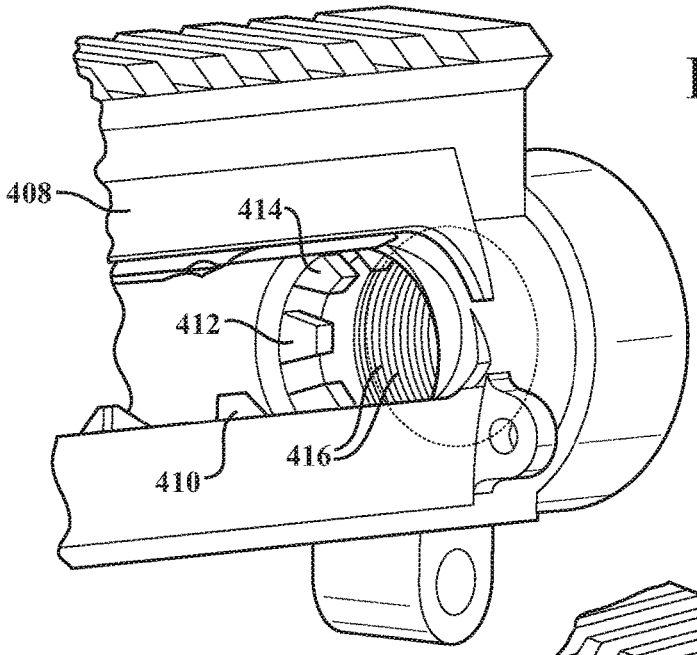
FIGS. 28 and 29 are first and second partial and rotated perspective views of an upper receiver incorporating a forward end located portion exhibiting radially inwardly projecting lugs arranged in a pattern for defining a receiving groove for seating the bolt lugs, as well as having a threaded forward end for directly receiving the barrel.
Figure 29:
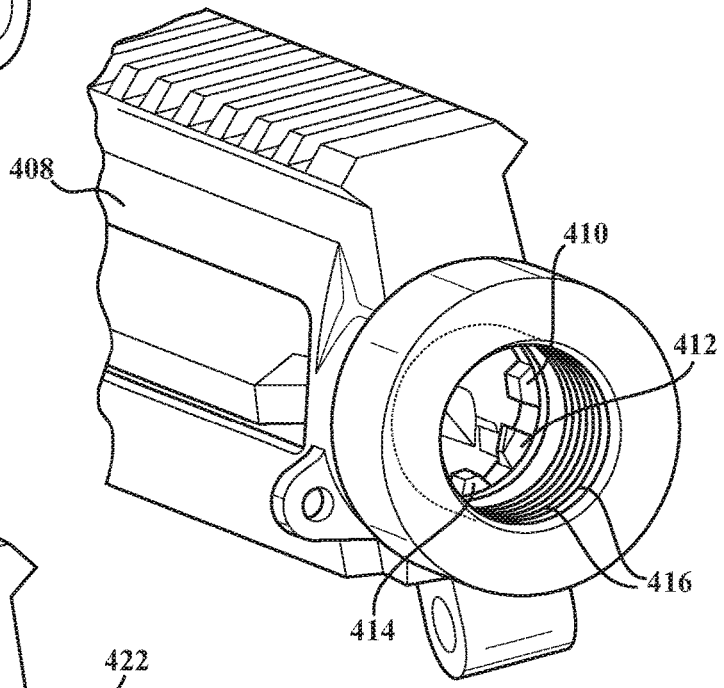

FIGS. 28 and 29 provide first and second partial and rotated perspective views of an upper receiver, at 408, incorporating a forward end located portion exhibiting a receiving groove pattern, and further depicted by an inwardly radially disposed array of lugs 410, 412, 414, et sq., these being integrated directly into the upper receiver for seating the bolt lugs as well as having a threaded forward end (see interior threads 416) for directly receiving an exteriorly threaded and attachable barrel.

Figure 30:
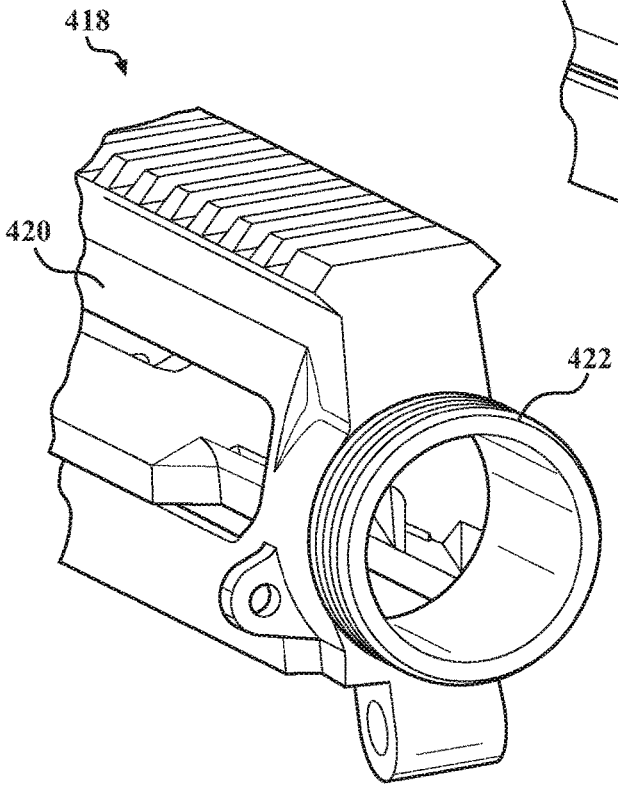
FIG. 30 is an illustration of a modified variation of an upper receiver in which the barrel extension geometry is copied into the upper receiver such that the barrel threads directly into the receiver.

Proceeding to FIG. 30, an illustration 418 is again shown of a modified variation of an upper receiver in which the barrel extension geometry is again copied into a further reconfiguration 420 of the upper receiver such that the barrel threads directly into the receiver. The forward end of the receiver includes an exteriorly threaded profile 422 which integrates a conventional barrel extension geometry copied into the upper receiver and to which is threadably engaged the barrel.

Figure 31:
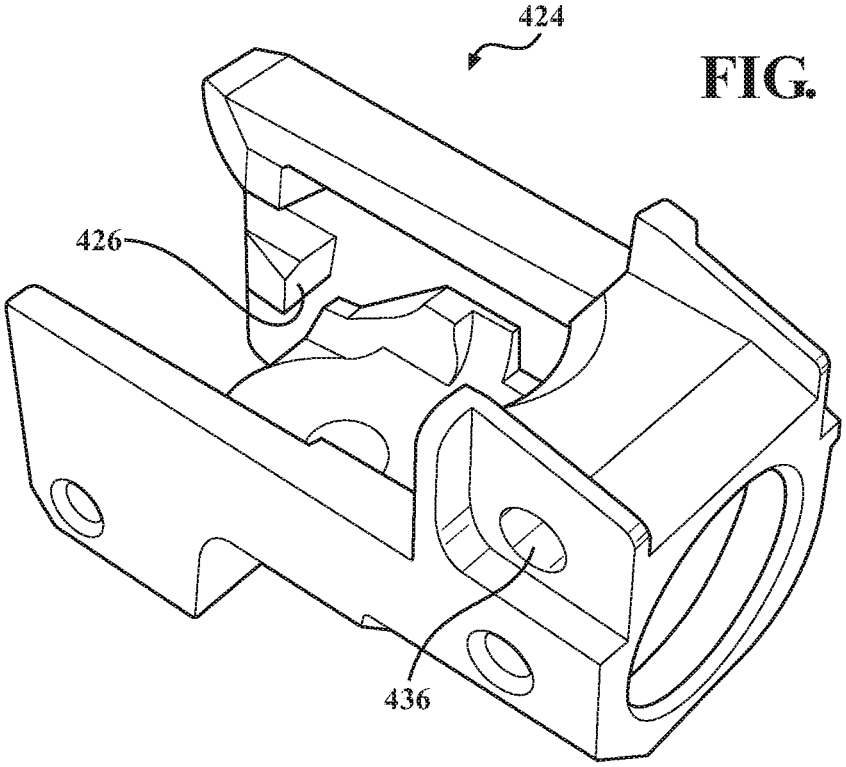
FIG. 31 is a perspective illustration of an attachable trunnion component according to a further variant of the Prior Art and exhibiting each of a bolt locking surface and a barrel mount location.

FIG. 31 is a perspective illustration of an attachable trunnion component 424 known the Prior Art exhibiting each of a bolt locking surface 426 and a barrel mount location 428 and which is configured for mating with the exteriorly radially arrayed and circumferentially spaced bolt lugs (e.g. such as previously depicted in numerous figures including at 214, 216, 218 et. seq. in FIG. 11).

The bolt lugs can again include any chamfered, angled, rounded, arcuate or other pattern suitable for mating with the trunnion configured lugs following the bolt lugs axially inserting through the circumferentially spaced recesses established between the inwardly arrayed trunnion lugs and subsequently rotating of the bolt and its lugs into mating and seated (non-locking) engagement with the upper receiver and its integrated trunnion component. Also depicted in FIG. 31 is a rear sight mounting point 430.

Figure 32:
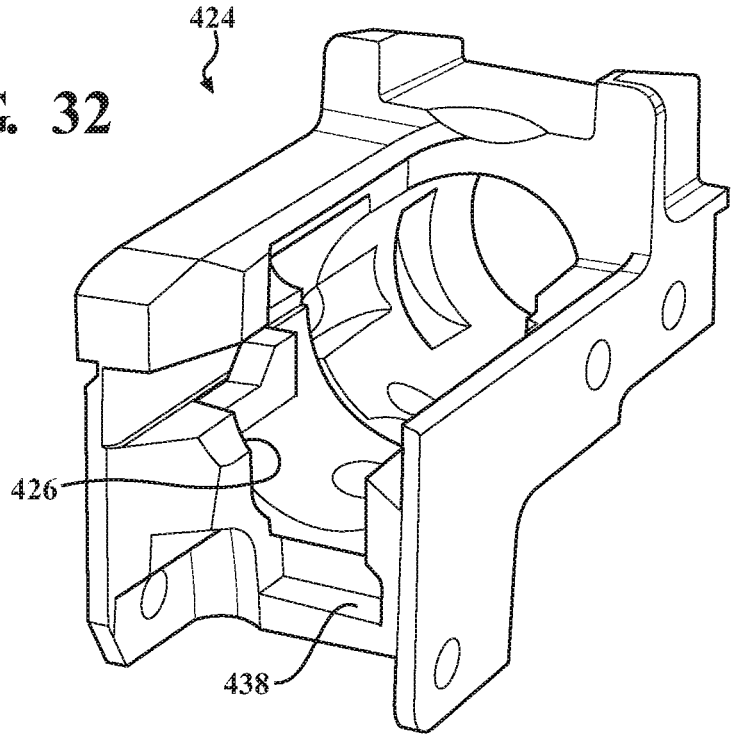
FIG. 32 is a rotated and rear end looking perspective of FIG. 31 again showing the barrel mount with bolt receiving grooves as well as front magazine catch.
Figure 31A:
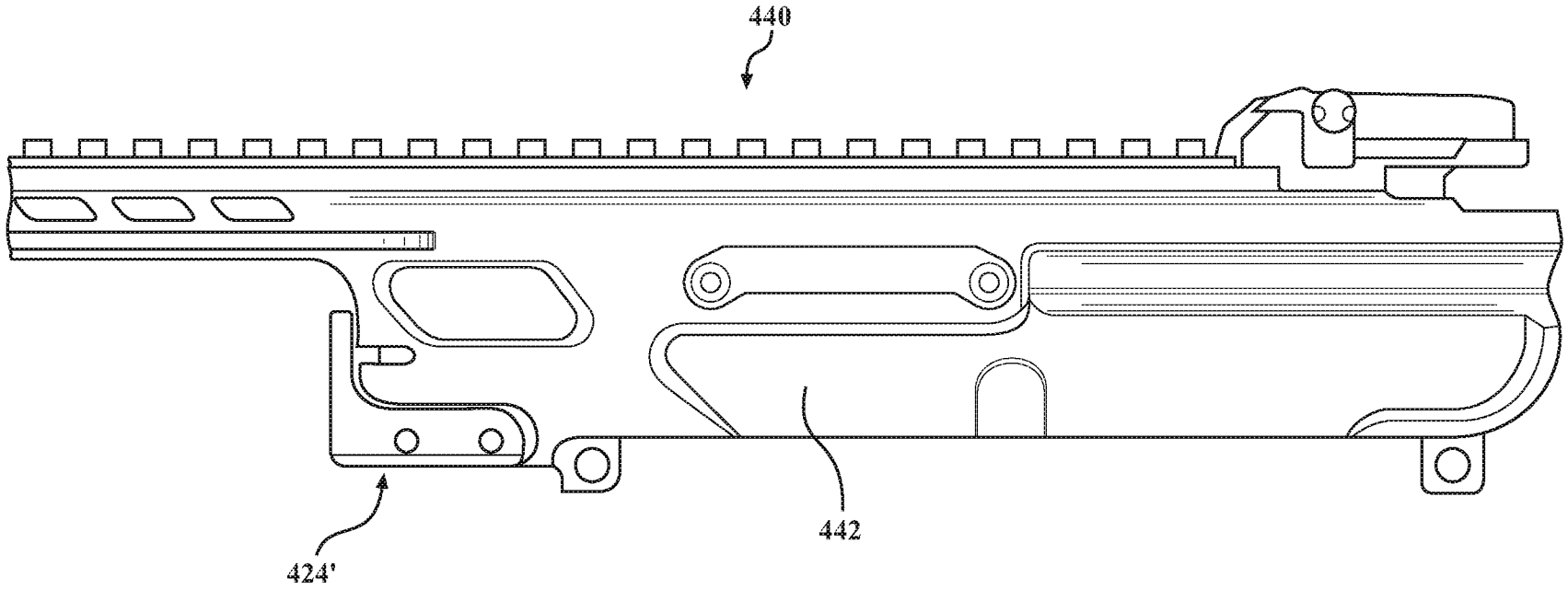
FIG. 31A is an illustration of an exemplary mounting variant as generally known in the Prior Art for securing a trunnion component either to or within the upper receiver component in communication with the barrel attachment.

FIG. 32 is a rotated and rear end looking perspective of FIG. 31 again showing the barrel mount aspects of the trunnion component as well as a front magazine catch 432. FIG. 31A is an illustration, generally at 440, as generally known in the prior art for securing a trunnion component (see at 424') either to an upper receiver 442 component in communication with the barrel attachment. As previously described, the trunnion component can be configured to be mounted to the upper receiver in communication with the barrel mount or, with reference to FIGS. 33-34, can be mounted within the upper receiver. In either instance, the trunnion component includes an array of barrel receiver grooves and interior radially projecting lugs which seat the barrel lugs in a manner consistent with the other described variants.

Finally, FIG. 33 is a partial perspective illustration of a further variant of trunnion component 444 incorporated into an upper receiver, further depicted in phantom at 446. The trunnion component 444 is again shown in FIG. 34 and includes a suitable interior lug pattern, see at 446, 448, 450, et seq., which mates (again an any of angle angled or rotationally inducing) profile with the opposing and seating lugs associated with the forward end of the bolt component.

Having described my invention, other and additional preferred embodiments will become apparent to those skilled in the art to which it pertains, and without deviating from the scope of the appended claims.

We claim:

1. A radial delay blowback mechanism for attenuating discharge forces resulting from firing of a projectile from a cartridge, the cartridge further including a cartridge case, said mechanism comprising:

a bolt and a carrier incorporated into an upper receiver of a firearm, a barrel secured to a trunnion affixed within the receiver, a trigger actuated firing pin supported within the carrier;

a plurality of radial bolt lugs configured at a forward end of the bolt, said lugs defining a mating angular profile which mate with a receiving profile of said trunnion during cycling of the bolt to a pre-cartridge discharge position so that the bolt is seated with but not locked to said trunnion;

a cam pin extending from the bolt and seating through a circumferentially directed slot configured within the carrier, said pin abutting against a first edge location of said slot when the bolt is in a set position at a beginning of a discharge cycle with the cartridge chambered and awaiting the discharge cycle;

upon initiating the discharge cycle, expanding gas forcing the cartridge case rearward into an end face of the bolt, causing the bolt to accelerate axially rearwardly concurrent with the projectile of the cartridge traveling through and out an end of the barrel, the bolt displacing relative to said trunnion along the mating angular profile to convert a portion of the axial acceleration into a rotation of the bolt, via said cam pin traveling within said circumferentially directed slot, the carrier is caused by the bolt to axially displace as the bolt rotates within the carrier, said lugs subsequently separating from said trunnion; and the bolt and carrier retaining sufficient inertia following separation of said lugs from the trunnion to permit successive rearward and forward return displacement to complete the discharge cycle and reload a subsequent cartridge.

2. The mechanism as described in claim 1, said mating angular profile defined along opposing contacting surfaces between said lugs and said mating profile further comprising said bolt lugs each having a forward angled edge.

3. The mechanism as described in claim 1, further comprising any of a truncated or limited cam path located upon the carrier.

4. The mechanism as described in claim 1, said angled mating profile including trunnion extension lugs, each having a plurality of circumferentially offset chamfered surfaces adapted to being engaged by said bolt lugs.

5. The mechanism as described in claim 1, further comprising an alignment spring biasing the bolt in a forward direction toward the barrel and the firing pin in an opposite rearward direction.

6. The mechanism as described in claim 5, the bolt further comprising a rearward most and reduced diameter annular projection about which is supported a forward end of said spring, the firing pin having an extended diameter projection against which is supported a rearward end of said spring.

7. The mechanism as described in claim 1, the carrier further comprising a solid carrier key preventing said bolt and carrier from being installed in a gas impingement upper group/firearm.

8. The mechanism as described in claim 1, said at least one of opposing contacting surfaces between said lugs and said receiving profile of said trunnion defining the mating angled profile and further comprising said bolt lugs each having a rounded profile.

9. The mechanism as described in claim 1, said mating angular profile further comprising said bolt lugs each having a rounded profile.

10. The mechanism as described in claim 1, said rotational inducing profile including trunnion extension lugs, each having a plurality of circumferentially offset chamfered surfaces adapted to being engaged by said bolt lugs.

11. A radial delay blowback mechanism for attenuating discharge forces resulting from firing of a projectile from a cartridge, the cartridge further including a cartridge case, said mechanism comprising:

a bolt and a carrier incorporated into an upper receiver of a firearm, a barrel secured to a trunnion affixed within the receiver, a trigger actuated firing pin supported within the carrier;

a plurality of radial bolt lugs configured at a forward end of the bolt, said lugs defining a rotational inducing profile when mated with a receiving profile of said trunnion during cycling of the bolt to a pre-cartridge discharge position so that the bolt is seated with but not locked to said trunnion;

upon initiating the discharge cycle, expanding gas forcing the cartridge case rearward into an end face of the bolt, causing the bolt to accelerate axially rearwardly concurrent with the projectile of the cartridge traveling through and out an end of the barrel, the bolt displacing relative to said trunnion along the mating angular profile to convert a portion of the axial acceleration into a rotation of the bolt, the carrier is caused by the bolt to axially displace as the bolt rotates within the carrier, said lugs subsequently separating from said trunnion; and the bolt and carrier retaining sufficient inertia following separation of said lugs from the trunnion to permit successive rearward and forward return displacement to complete the discharge cycle and reload a subsequent cartridge.

12. The mechanism of claim 11, further comprising a cam pin extending from the bolt and seating through a circumferentially directed slot configured within the carrier, said pin abutting against a first edge location of said slot when the bolt is in a set position at a beginning of a discharge cycle with the cartridge chambered and awaiting the discharge cycle, upon initiating the discharge cycle said cam pin traveling within said circumferentially directed slot.

13. The mechanism as described in claim 11, said rotational inducing profile further comprising said bolt lugs each having a rounded profile.

14. The mechanism as described in claim 11, said rotational inducing profile further comprising said bolt lugs each having a forward angled edge.

15. The mechanism as described in claim 11, further comprising any of a truncated or limited cam path located upon the carrier.

16. The mechanism as described in claim 11, further comprising an alignment spring biasing the bolt in a forward direction toward the barrel and the firing pin in an opposite rearward direction.

17. The mechanism as described in claim 16, the bolt further comprising a rearward most and reduced diameter annular projection about which is supported a forward end of said spring, the firing pin having an extended diameter projection against which is supported a rearward end of said spring.

18. The mechanism as described in claim 11, the carrier further comprising a solid carrier key preventing said bolt and carrier from being installed in a gas impingement upper group/firearm.

19. A radial delay blowback mechanism for attenuating discharge forces resulting from firing of a projectile from a cartridge, the cartridge further including a cartridge case, said mechanism comprising:

a bolt and a carrier incorporated into an upper receiver of a firearm, a barrel secured to the receiver, a trigger actuated firing pin supported within the carrier;

a plurality of radial bolt lugs configured at a forward end of the bolt, said lugs defining a mating angular profile which mate with a receiving profile incorporated within said upper receiver during cycling of the bolt to a pre-cartridge discharge position so that the bolt is seated with but not locked to said upper receiver;

a cam pin extending from the bolt and seating through a circumferentially directed slot configured within the carrier, said pin abutting against a first edge location of said slot when the bolt is in a set position at a beginning of a discharge cycle with the cartridge chambered and awaiting the discharge cycle;

upon initiating the discharge cycle, expanding gas forcing the cartridge case rearward into an end face of the bolt, causing the bolt to accelerate axially rearwardly concurrent with the projectile of the cartridge traveling through and out an end of the barrel, the bolt displacing relative to said upper receiver along the mating angular profile to convert a portion of the axial acceleration into a rotation of the bolt, via said cam pin traveling within said circumferentially directed slot, the carrier is caused by the bolt to axially displace as the bolt rotates within the carrier, said lugs subsequently separating from said receiver; and the bolt and carrier retaining sufficient inertia following separation of said lugs from the trunnion to permit successive rearward and forward return displacement to complete the discharge cycle and reload a subsequent cartridge.

20. The mechanism of claim 19, said receiving profile within said upper receiver further comprising a plurality of inwardly radially disposed array of lugs integrated directly into the upper receiver for seating said bolt lugs, a forward end of said receiver exhibiting interior threads for inter engaging an exteriorly threaded and attachable barrel.

* * * * *